US007990320B2

(12) United States Patent
Pros et al.

(10) Patent No.: US 7,990,320 B2
(45) Date of Patent: Aug. 2, 2011

(54) ANTENNA WITH INNER SPRING CONTACT

(75) Inventors: Jaume Anguera Pros, Vinaros (ES); Juan Ignacio Ortigosa Vallejo, Barcelona (ES); Alfonso Sanz, Barcelona (ES)

(73) Assignee: Fractus, S.A., Barcelona (ES)

( * ) Notice: Subject to any disclaimer, the term of this patent is extended or adjusted under 35 U.S.C. 154(b) by 323 days.

(21) Appl. No.: 11/989,435

(22) PCT Filed: Jul. 31, 2006

(86) PCT No.: PCT/EP2006/007565

§ 371 (c)(1),
(2), (4) Date: Apr. 8, 2008

(87) PCT Pub. No.: WO2007/014737

PCT Pub. Date: Feb. 8, 2007

(65) Prior Publication Data

US 2009/0146906 A1 Jun. 11, 2009

Related U.S. Application Data

(60) Provisional application No. 60/704,542, filed on Aug. 2, 2005.

(30) Foreign Application Priority Data

Aug. 1, 2005 (EP) ..... 05107095

(51) Int. Cl.
*H01Q 1/38* (2006.01)

(52) U.S. Cl. ..... 343/700 MS; 343/702

(58) Field of Classification Search ..... 843/700 MS, 843/846, 702

See application file for complete search history.

(56) References Cited

U.S. PATENT DOCUMENTS 6,414,641 B1 7/2002 Carlson et al.
6,542,122 B1 4/2003 Bolin et al.
6,600,448 B2 7/2003 Ikegaya et al.
6,603,432 B2 8/2003 Hill et al.

(Continued)

FOREIGN PATENT DOCUMENTS

EP 1657785 A1 5/2006

(Continued)

OTHER PUBLICATIONS

Yokowo, Spring-connector applications for mobile phone, www.yokowo.co.jp (Technical brochure), Jul. 2005 .

(Continued)

*Primary Examiner* — HoangAnh T Le
(74) *Attorney, Agent, or Firm* — Winstead PC

(57) ABSTRACT

One aspect of the invention relates to an antenna for a wireless device having spring contact elements based on strips (301, 302; 403; 503, 504; 602, 603; 612, 613; 622, 623; 632; 642; 652, 653; 682; 703, 704; 753, 754; 756; 802, 803; 1412, 1413; 1422, 1423) that, before bending, are housed in at least one gap (303, 601, 681, 804, 1411, 1421) in a main body (300, 402, 502, 600, 700, 750, 800 1400) of the antenna. The invention provides for a reduced stamping area overhead while allowing the spring contacts embodied by the strips to be placed close to the perimeter of the smallest possible rectangle that can house the main body. This can be helpful for mounting the antenna close to an edge of a printed circuit board (401, 501, 701, 801) while not extending beyond said edge.

58 Claims, 13 Drawing Sheets

U.S. PATENT DOCUMENTS

Figure 1:
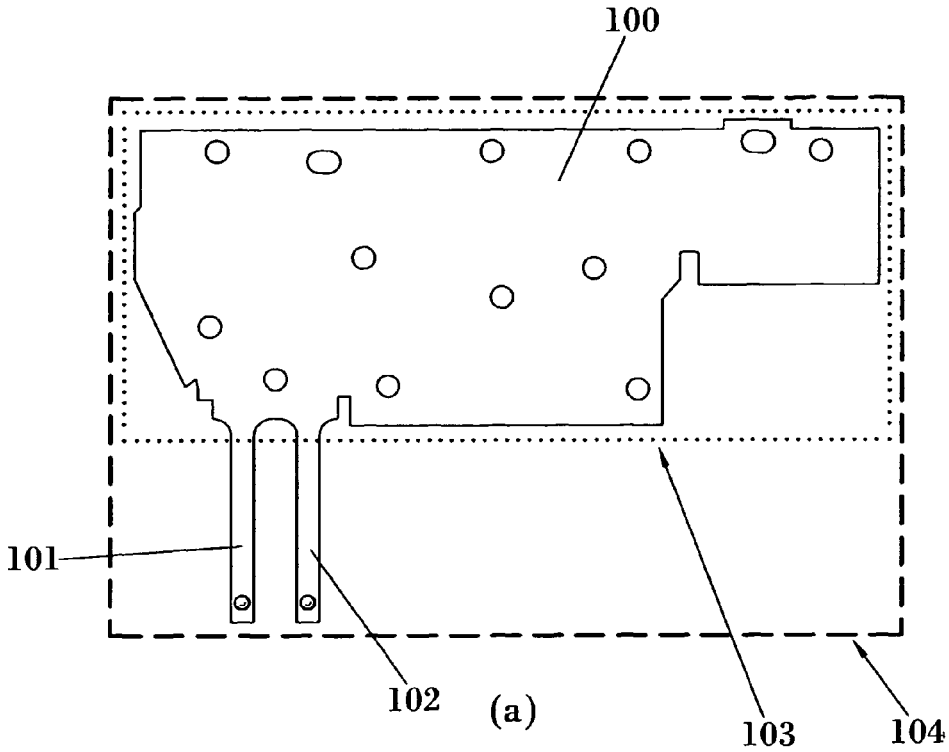
FIG. 1 (PRIOR ART)
Figure 1:
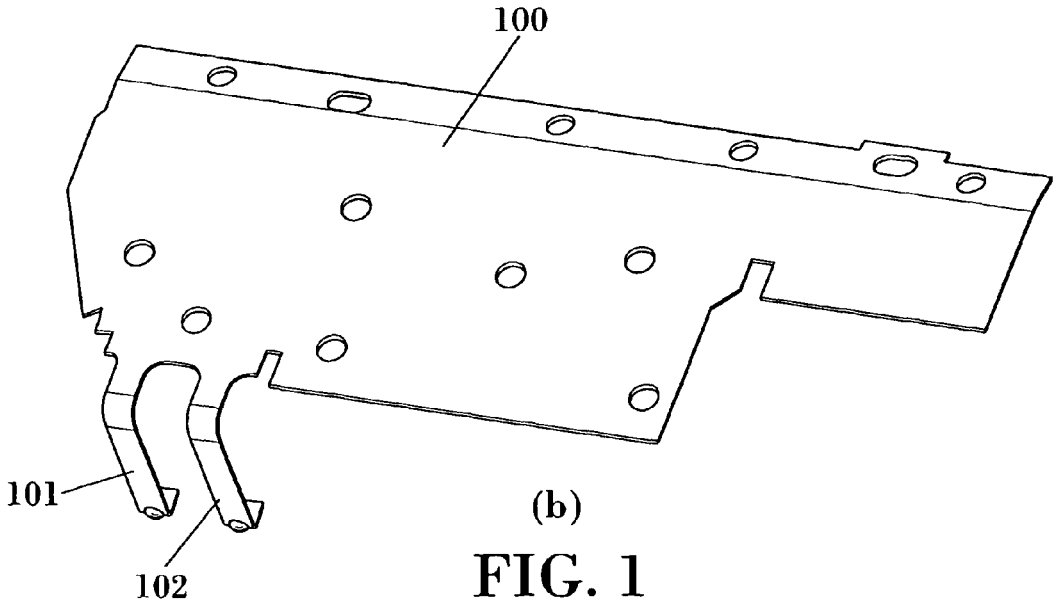
FIG. 1 (PRIOR ART)

| | | | | |
|---|---|---|---|---|
| 6,856,286 | B2 * | 2/2005 | Jo et al. | 343/700 MS |
| 6,963,310 | B2 * | 11/2005 | Horita et al. | 343/702 |
| 2003/0071756 | A1 | 4/2003 | Bolin et al. | |

FOREIGN PATENT DOCUMENTS

| | | | |
|---|---|---|---|
| JP | 4157908 | | 5/1992 |
| JP | 2003-101336 | * | 4/2003 |
| JP | 2005-167960 | | 6/2005 |
| JP | 4157908 | | 4/2008 |
| WO | 0137369 | A1 | 5/2001 |
| WO | 03041216 | A2 | 5/2003 |
| WO | WO-03/041216 | | 5/2003 |
| WO | 03058754 | A1 | 7/2003 |
| WO | 2004047222 | A1 | 6/2004 |
| WO | 2005020371 | A1 | 3/2005 |
| WO | 2005031914 | A2 | 4/2005 |
| WO | WO-2005/031914 | | 4/2005 |

OTHER PUBLICATIONS

Long S. A. Rebuttal expert report of Dr. Stuart A. Long (redacted version). Fractus, Feb. 16, 2011.

Jaggard , D. L. Rebuttal expert report of Dr. Dwight L. Jaggard (redacted version). Fractus, Feb. 16, 2011.

Jaggard , D. L. Expert report of Dwight L. Jaggard (redacted)—expert witness retained by Fractus. Fractus 16, 2011.

Nokia 3360. Nokia. May 2001.

Nokia 8265. Nokia. Mar. 2002.

* cited by examiner (a)

(b)

(a)

(b)

(a)

(b)

(a)

(b)

(a)

(b)

ANTENNA WITH INNER SPRING CONTACT

CROSS-REFERENCE TO RELATED APPLICATIONS

This patent application claims the benefit of priority from U.S. Provisional Patent Application No. 60/704,542 filed Aug. 2, 2005.

OBJECT OF THE INVENTION

The present invention relates to antennas, to antenna systems, to handsets, and generally to any wireless device, which includes an antenna for receiving and transmitting electromagnetic wave signals.

It is an object of the present invention to provide an antenna for a handset or for a wireless device (such as for instance a mobile phone, a smartphone, a PDA, a MP3 player, a headset, a USB dongle, a laptop, a PCMCIA or Cardbus 32 card), wherein the antenna features at least one inner spring contact. Another aspect of the invention relates to a method for contacting the antenna by means of an inner spring contact. A further aspect of the present invention relates to the integration capabilities of a handset or wireless device comprising an antenna with inner spring contacts.

BACKGROUND OF THE INVENTION

A typical antenna for wireless devices (such as for instance, and without limitation, a handset, a mobile phone, a smartphone, a PDA, a MP3 player, a headset, a USB dongle, a laptop, a PCMCIA or a Cardbus 32 card), comprises a conductive plate or wire usually mounted on a carrier made of plastic (such as for instance Poly Carbonate, Liquid Crystal Polymer, Poly Oxide Methylene, PC-ABS, or PVC) that provides mechanical support.

The antenna is assembled in the wireless device, forming an integral part of the device. The wireless device will usually comprise a multilayer printed circuit board (PCB) on which it carries the electronics. One of the layers of the multilayer PCB typically serves as a ground plane of the antenna.

One way of contacting the antenna is by means of a spring contact. A spring contact comprises a strip or similar of a conductive material (typically, metal) that includes one or several bends forming a spring (i.e., a structure capable of exerting a tensional strength when pressure is applied to it). When the antenna is assembled onto the PCB of the wireless device, the mechanical interference of the tip of the spring contact with the PCB results in the spring contact applying a tensional strength on the landing area of the PCB (such as, for example, a pad), ensuring good electrical continuity between the antenna and the relevant tracks in the PCB.

In some cases the spring contact is used to feed the antenna, establishing an electrical path to connect the antenna with a radio frequency (RF) front-end of the circuit, or an RF input/output of an electronic device, on the PCB. In other cases, the spring contact is used to connect the antenna to the ground plane of the PCB, which can be advantageous to tailor the input impedance of the antenna, or the resonant modes of the antenna, or a combination of both effects.

Usually, the landing area of a spring contact on the PCB of the wireless device is substantially close to an edge of the PCB (for example, the top edge of the PCB in a handset). Such an arrangement is preferable because a resonant mode of the antenna can advantageously excite currents on the ground plane of the PCB that flow along the entire length of said ground plane, enhancing the radiation process. This is particularly interesting for small-sized handsets (such as, for instance, bar-type, clamshell-type, slider-type or swivel-type handsets), because of the reduced dimensions of the ground plane. The requirement of feeding the antenna close to an edge of the PCB makes it advantageous to provide the spring contacts of the antenna at points close to the perimeter of the conductive plate of the antenna.

A typical process used for the fabrication of antennas for wireless devices comprises the steps of stamping a flat solid plate of conductive material (such as, for example, copper, aluminum, brass, silver, gold, or some other type of good conducting alloy) to cut the shape of the perimeter of the antenna out of the original flat solid plate. The resulting piece of conductive material is a flat structure. Pressure can then be applied to the structure in one or several steps, to bend portions of the piece of conductive material and define the three-dimensional structure of the antenna (such as for example to create capacitive loading elements, or to conform the conductive plate to a plastic carrier, or to a plastic cover, or chassis, of a wireless device).

When an antenna comprises one or more spring contacts, the stamping process defines a shape of the perimeter of the antenna including strips protruding from the main body of the antenna. The strips will then be bent in order to provide the adequate shape to the spring contacts.

In general, when fabricating an antenna comprising one or several spring contacts by means of a process involving the step of stamping of a plate of conductive material, the area of the smallest possible rectangle that completely encloses the perimeter of the main body of the antenna and the strips of the spring contacts (hereinafter also referred to as the antenna total area) will be significantly larger than the area of the smallest possible rectangle that completely encloses the perimeter of the main body of the antenna but not necessarily the strips of the spring contacts (hereinafter also referred to as the antenna body area). In the context of this patent application, the stamping area overhead is defined as the difference between the antenna total area and the antenna body area.

For illustration purposes, and without any limitation, FIG. 1 presents an example of an antenna fabricated by stamping a plate of a conductive material. The antenna comprises a main body (100) and two strips, labeled as (101) and (102), that will be used to create two spring contacts. FIG. 1*a* depicts the antenna as a flat structure, before bending the strips (101, 102) to form the spring contacts (see FIG. 1*b*). In FIG. 1*a*, the main body (100) and the strips (101, 102) are coplanar. The smallest possible rectangle that encompasses the perimeter of the antenna, including both the perimeter of the main body (100) and that of the strips (101, 102), is indicated with reference numeral (104). The smallest possible rectangle that encompasses the perimeter of the main body of the antenna (100), not necessarily including the strips (101, 102), is indicated with reference numeral (103). From the figure, it is clear that the area of rectangle (103) (i.e., the antenna body area) is smaller than the area of rectangle (104) (i.e., the antenna total area), this difference being the stamping area overhead. The stamping area overhead of the antenna is due to the fact that the strips (101, 102) protrude from the perimeter of the main body of the antenna (100) towards the outside, and this overhead implies an additional rectangular area of conducting plate for the stamping process of the antenna, which in turn translates into extra costs. Moreover, this additional area of conducting plate is used very inefficiently, as only the portion corresponding to the strips (101) and (102) will be retained after the stamping process, while the rest of the material will be discarded.

Some attempts have been made to try to reduce the stamping area overhead of the antenna (and hence the cost associated to using an additional amount of conductive material) by designing the spring contacts in such a way that the antenna total area is approximately the same as the antenna body area.

Figure 2:
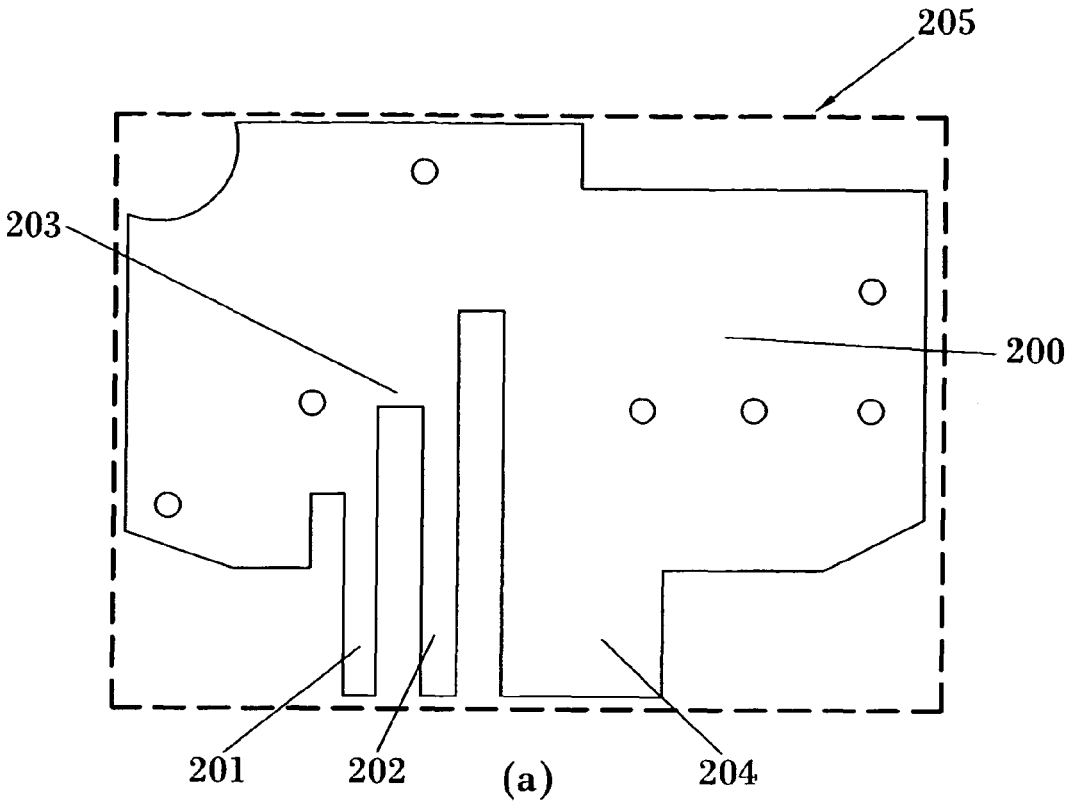
FIG. 2 (PRIOR ART)
Figure 2:
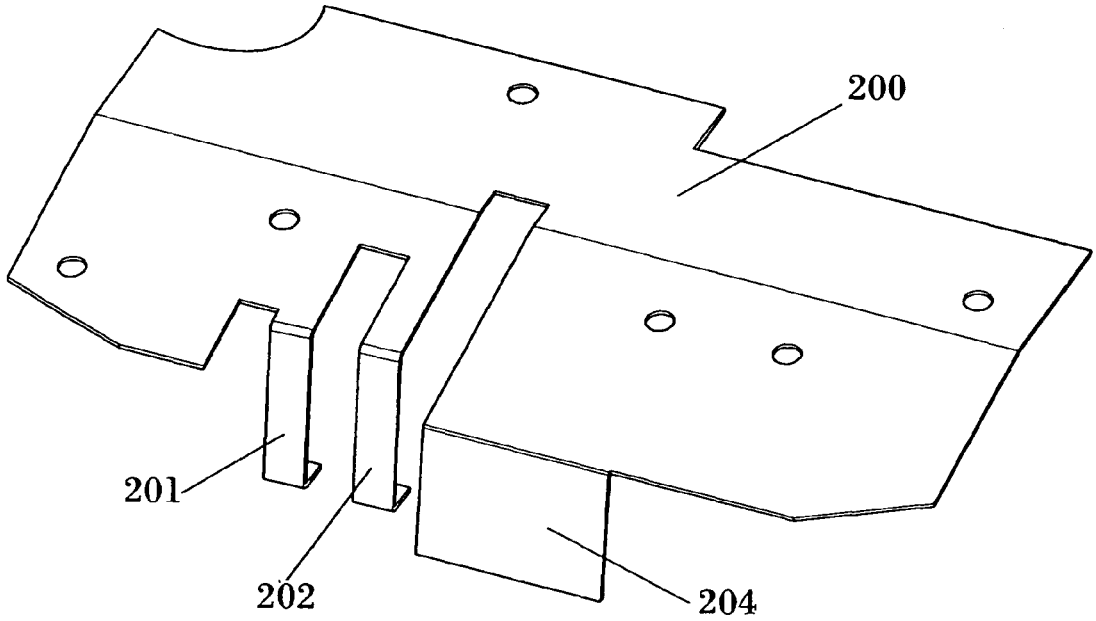
FIG. 2 (PRIOR ART)

In these cases, such as for instance the example illustrated in FIG. 2, the geometry of the main body of the antenna (200) is modified in the region (203), in which the strips of spring contacts (201, 202) are connected to the main body (200). The shape of the main body of the antenna (200) recedes in that region (203) to allow the conducting strips of the spring contacts (201, 202) to be placed without extending beyond the minimum rectangle (205) that encompasses the perimeter of the main body of the antenna (200).

However, when folding the strips (201, 202) to shape the spring contacts (as depicted in FIG. 2*b*), the projection of the strips (201, 202) on the PCB on which the antenna is mounted will be shorter than the original length of the unfolded strips (201, 202), which means that the landing area of the spring contacts on said PCB will not occur near the edge of the PCB (assuming that the main body of the antenna does not extend beyond said edge). In the context of this document, by the term "projection" it is understood the orthogonal projection on the plane defined by a PCB of the handset or wireless device.

To keep the landing area of the spring contacts near the edge of the PCB, the antenna must be displaced parallel to the plane of the PCB until the landing area of the spring contacts is substantially close to the edge of the PCB, but this means that a portion of the antenna has a projection beyond the edge of the PCB, thus making the device larger unless said portion of the antenna is folded downwards forming a capacitive load. For example, such a portion (204) of the antenna in FIG. 2*a* has been bent approximately 90 degrees in FIG. 2*b* to allow the spring contacts (201, 202) to land near an edge of a PCB, without said portion (204) extending beyond said edge. However, this solution presents some important limitations. For example, the mechanical design of the spring contact cannot be treated independently from the electrical design of the antenna. A change in the height of the antenna to increase the bandwidth, or in the length of the capacitive element (204) to tune the operating bands, will make it necessary to redesign the spring contact, and modify the length of the strips (201) and (202). Similarly, a change in the shape of the spring contact to increase the tensional strength exerted on the landing area of the PCB, will make it necessary to modify the electrical design of the antenna, for instance the length of the capacitive loading element (204), in order not to increase the antenna total area with respect to the antenna body area, and incur in a stamping area overhead.

In the examples of antennas with spring contacts shown in FIGS. 1 and 2, the strips of conductive material that will be used to create the spring contacts (101, 102, 201, 202) protrude from the main body of the antenna (100, 200) towards the outside, which is clearly different from the antennas with inner spring contacts of the present invention.

The present invention discloses a novel type of antennas that comprise an inner spring contact. According to the present invention the inner spring contact allows to feed the antenna at an edge of the PCB on which the antenna is mounted, while avoiding substantially any stamping area overhead.

Space Filling Curves

In some examples, the antenna may be miniaturized by shaping at least a portion of the conducting trace, conducting wire or contour of a conducting sheet of the antenna (e.g., a part of the arms of a dipole, the perimeter of the patch of a patch antenna, the slot in a slot antenna, the loop perimeter in a loop antenna, or other portions of the antenna) as a space-filling curve (SFC).

A SFC is a curve that is large in terms of physical length but small in terms of the area in which the curve can be included. More precisely, for the purposes of this patent document, a SFC is defined as follows: a curve having at least five segments, or identifiable sections, that are connected in such a way that each segment forms an angle with any adjacent segments, such that no pair of adjacent segments defines a larger straight segment. In addition, a SFC does not intersect with itself at any point except possibly the initial and final point (that is, the whole curve can be arranged as a closed curve or loop, but none of the lesser parts of the curve form a closed curve or loop). A SFC can comprise straight segments, curved segments, or a combination of both.

A space-filling curve can be fitted over a flat or curved surface, and due to the angles between segments, the physical length of the curve is larger than that of any straight line that can be fitted in the same area (surface) as the space-filling curve. Additionally, to shape the structure of a miniature antenna, the segments of the SFCs should be shorter than at least one fifth of the free-space operating wavelength, and possibly shorter than one tenth of the free-space operating wavelength. The space-filling curve should include at least five segments in order to provide some antenna size reduction, however a larger number of segments may be used. In general, the larger the number of segments and the narrower the angles between them, the smaller the size of the final antenna.

Box-Counting Curves

In other examples, the antenna may be miniaturized by shaping at least a portion of the conducting trace, conducting wire or contour of a conducting sheet of the antenna to have a selected box-counting dimension.

For a given geometry lying on a surface, the box-counting dimension is computed as follows. First, a grid with substantially squared identical cells boxes of size L1 is placed over the geometry, such that the grid completely covers the geometry, that is, no part of the curve is out of the grid. The number of boxes N1 that include at least a point of the geometry are then counted. Second, a grid with boxes of size L2 (L2 being smaller than L1) is also placed over the geometry, such that the grid completely covers the geometry, and the number of boxes N2 that include at least a point of the geometry are counted. The box-counting dimension D is then computed as:

$$D = -\frac{\log(N2) - \log(N1)}{\log(L2) - \log(L1)}$$

For the purposes of the antenna with at least one inner spring contact described herein, the box-counting dimension may be computed by placing the first and second grids inside a minimum rectangular area enclosing the conducting trace, conducting wire or contour of a conducting sheet of the antenna and applying the above algorithm. The first grid should be chosen such that the rectangular area is meshed in an array of at least 5×5 boxes or cells, and the second grid should be chosen such that L2=½L and such that the second grid includes at least 10×10 boxes. The minimum rectangular area is an area in which there is not an entire row or column on the perimeter of the grid that does not contain any piece of the curve. Further, the minimum rectangular area preferably refers to the smallest possible rectangular area that completely encloses the curve.

The desired box-counting dimension for the curve may be selected to achieve a desired amount of miniaturization. The box-counting dimension should be larger than 1.1 in order to achieve some antenna size reduction. If a larger degree of miniaturization is desired, then a larger box-counting dimension may be selected, such as a box-counting dimension ranging from 1.5 to 3. For the purposes of this patent document, curves in which at least a portion of the geometry of the curve, or the entire curve, has a box-counting dimension larger than 1.1 are referred to as box-counting curves.

For very small antennas, for example antennas that fit within a rectangle having maximum size equal to one-twentieth the longest free-space operating wavelength of the antenna, the box-counting dimension may be computed using a finer grid. In such a case, the first grid may include a mesh of 10×10 equal cells, and the second grid may include a mesh of 20×20 equal cells. The box-counting dimension (D) may then be calculated using the above equation.

In general, for a given resonant frequency of the antenna, the larger the box-counting dimension, the higher the degree of miniaturization that will be achieved by the antenna. One way to enhance the miniaturization capabilities of the antenna is to arrange the several segments of the curve of the antenna pattern in such a way that the curve intersects at least one point of at least 14 boxes of the first grid with 5×5 boxes or cells enclosing the curve. If a higher degree of miniaturization is desired, then the curve may be arranged to cross at least one of the boxes twice within the 5×5 grid, that is, the curve may include two non-adjacent portions inside at least one of the cells or boxes of the grid.

Figure 9:
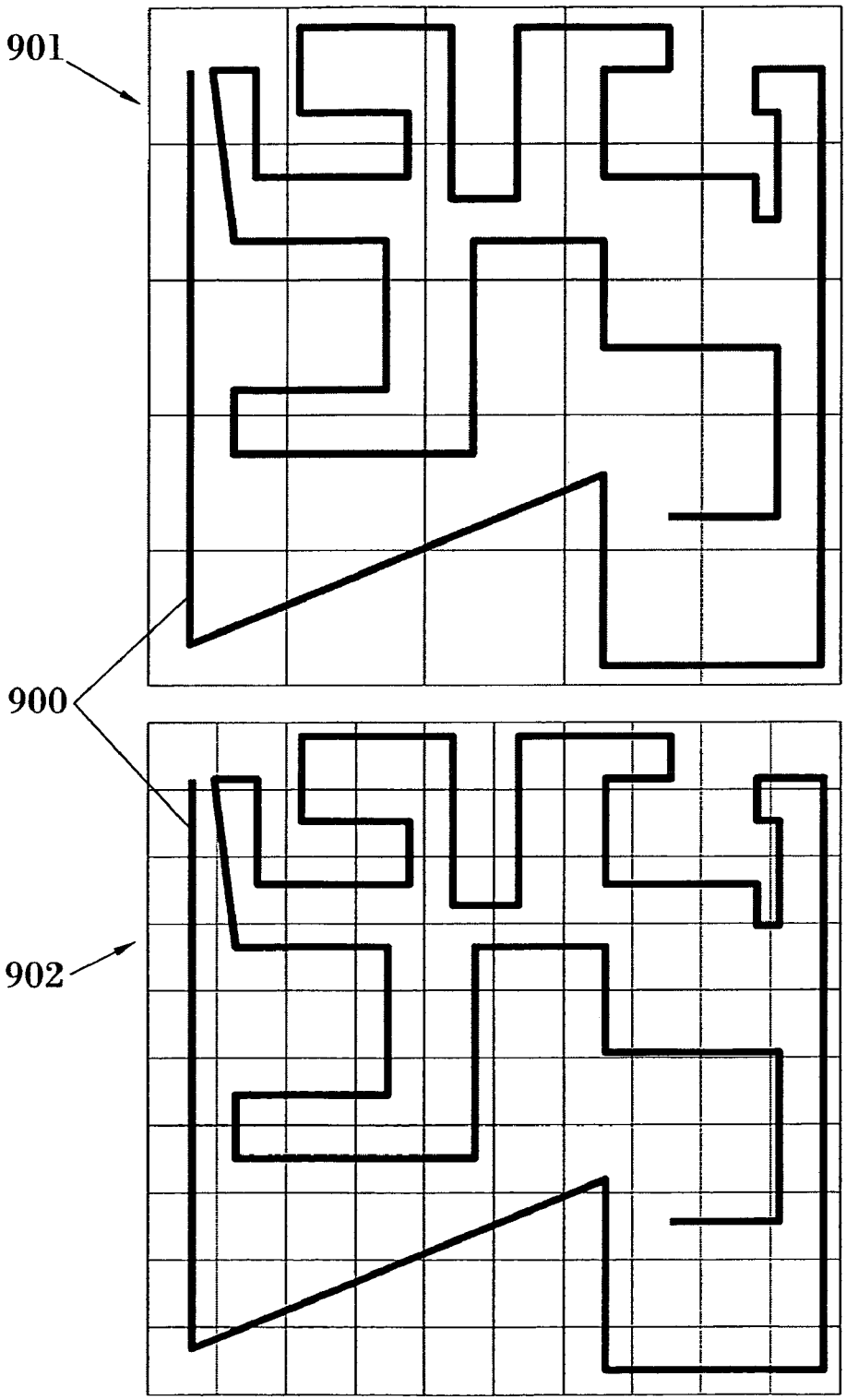

FIG. 9 illustrates an example of how the box-counting dimension of a curve (900) is calculated. The example curve (900) is placed under a 5×5 grid (901) (FIG. 9 upper part) and under a 10×10 grid (902) (FIG. 9 lower part). As illustrated, the curve (900) touches N1=25 boxes in the 5×5 grid (901) and touches N2=78 boxes in the 10×10 grid (902). In this case, the size of the boxes in the 5×5 grid (901) is twice the size of the boxes in the 10×10 grid (902). By applying the above equation, the box-counting dimension of the example curve (900) may be calculated as D=1.6415. In addition, further miniaturization is achieved in this example because the curve (900) crosses more than 14 of the 25 boxes in grid (901), and also crosses at least one box twice, that is, at least one box contains two non-adjacent segments of the curve. More specifically, the curve (900) in the illustrated example crosses twice in 13 boxes out of the 25 boxes.

Grid Dimension Curves

In further examples, the antenna may be miniaturized by shaping at least a portion of the conducting trace, conducting wire or contour of a conducting sheet of the antenna to include a grid dimension curve.

For a given geometry lying on a planar or curved surface, the grid dimension of curve may be calculated as follows. First, a grid with substantially identical cells of size L1 is placed over the geometry of the curve, such that the grid completely covers the geometry, and the number of cells N1 that include at least a point of the geometry are counted. Second, a grid with cells of size L2 (L2 being smaller than L1) is also placed over the geometry, such that the grid completely covers the geometry, and the number of cells N2 that include at least a point of the geometry are counted again. The grid dimension D is then computed as:

$$D = -\frac{\log(N2) - \log(N1)}{\log(L2) - \log(L1)}$$

For the purposes of the antenna with at least one inner spring contact described herein, the grid dimension may be calculated by placing the first and second grids inside the minimum rectangular area enclosing the curve of the antenna and applying the above algorithm. The minimum rectangular area is an area in which there is not an entire row or column on the perimeter of the grid that does not contain any piece of the curve. Further the minimum rectangular area preferably refers to the smallest possible rectangular area that completely encloses the curve.

The first grid may, for example, be chosen such that the rectangular area is meshed in an array of at least 25 substantially equal cells. The second grid may, for example, be chosen such that each cell of the first grid is divided in 4 equal cells, such that the size of the new cells is L2=½ L1, and the second grid includes at least 100 cells.

The desired grid dimension for the curve may be selected to achieve a desired amount of miniaturization. The grid dimension should be larger than 1 in order to achieve some antenna size reduction. If a larger degree of miniaturization is desired, then a larger grid dimension may be selected, such as a grid dimension ranging from 1.5-3 (e.g., in case of volumetric structures). In some examples, a curve having a grid dimension of about 2 may be desired. For the purposes of this patent document, a curve or a curve where at least a portion of that curve is having a grid dimension larger than 1 is referred to as a grid dimension curve.

In general, for a given resonant frequency of the antenna, the larger the grid dimension the higher the degree of miniaturization that will be achieved by the antenna. One example way of enhancing the miniaturization capabilities of the antenna is to arrange the several segments of the curve of the antenna pattern in such a way that the curve intersects at least one point of at least 50% of the cells of the first grid with at least 25 cells enclosing the curve. In another example, a high degree of miniaturization may be achieved by arranging the antenna such that the curve crosses at least one of the cells twice within the 25-cell grid, that is, the curve includes two non-adjacent portions inside at least one of the cells or cells of the grid.

Figure 10:
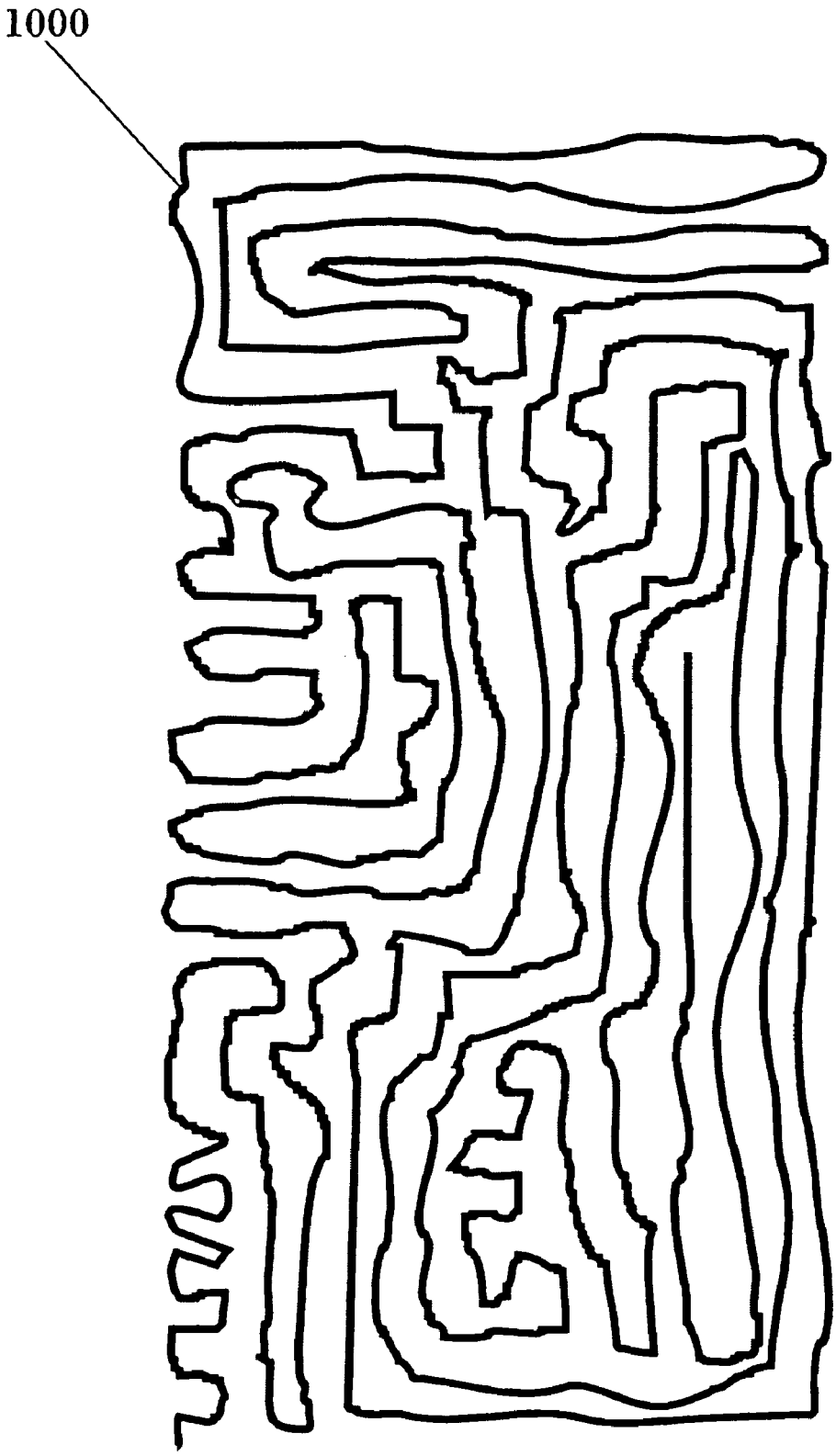
Figure 11:
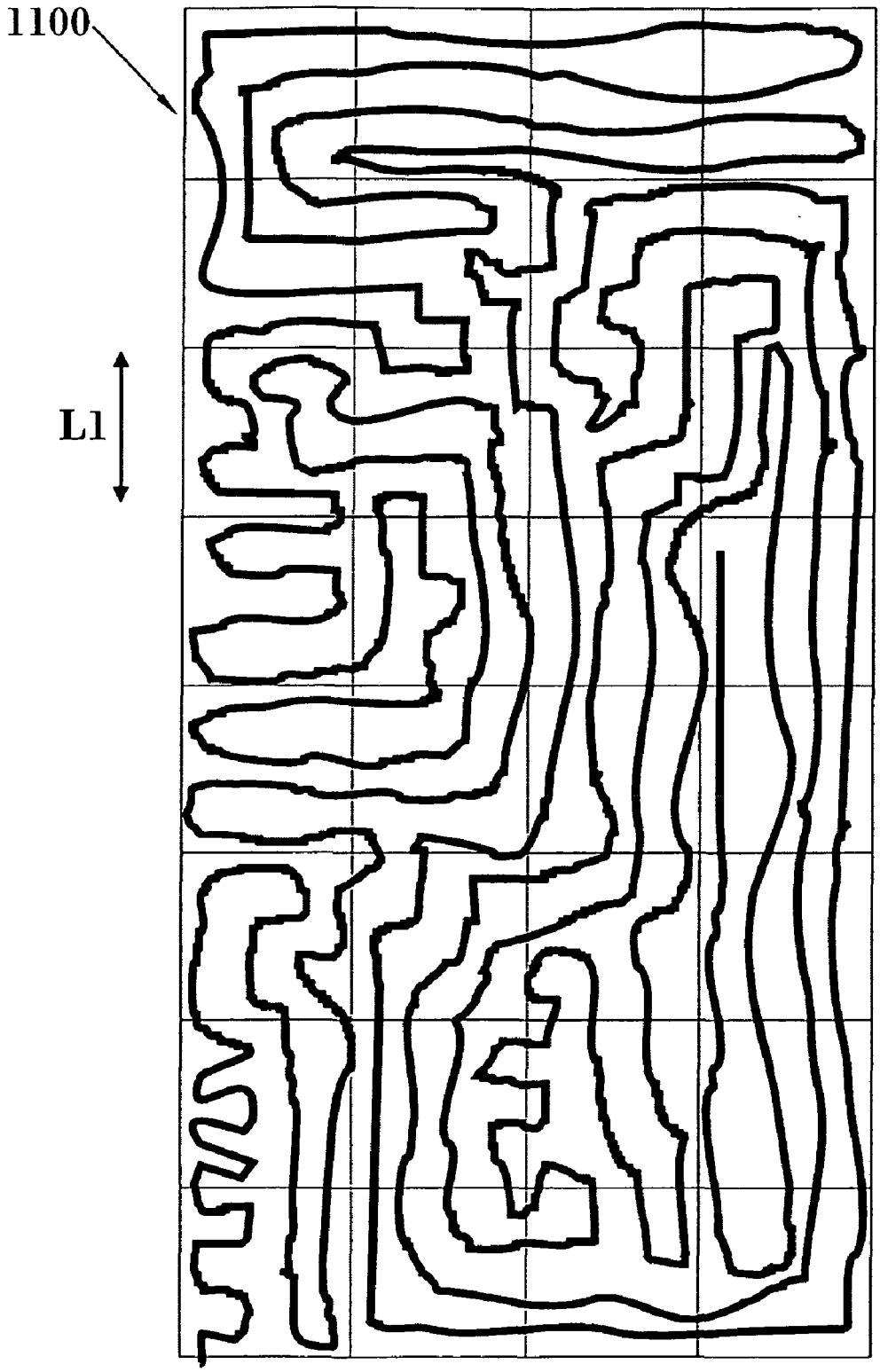
Figure 12:
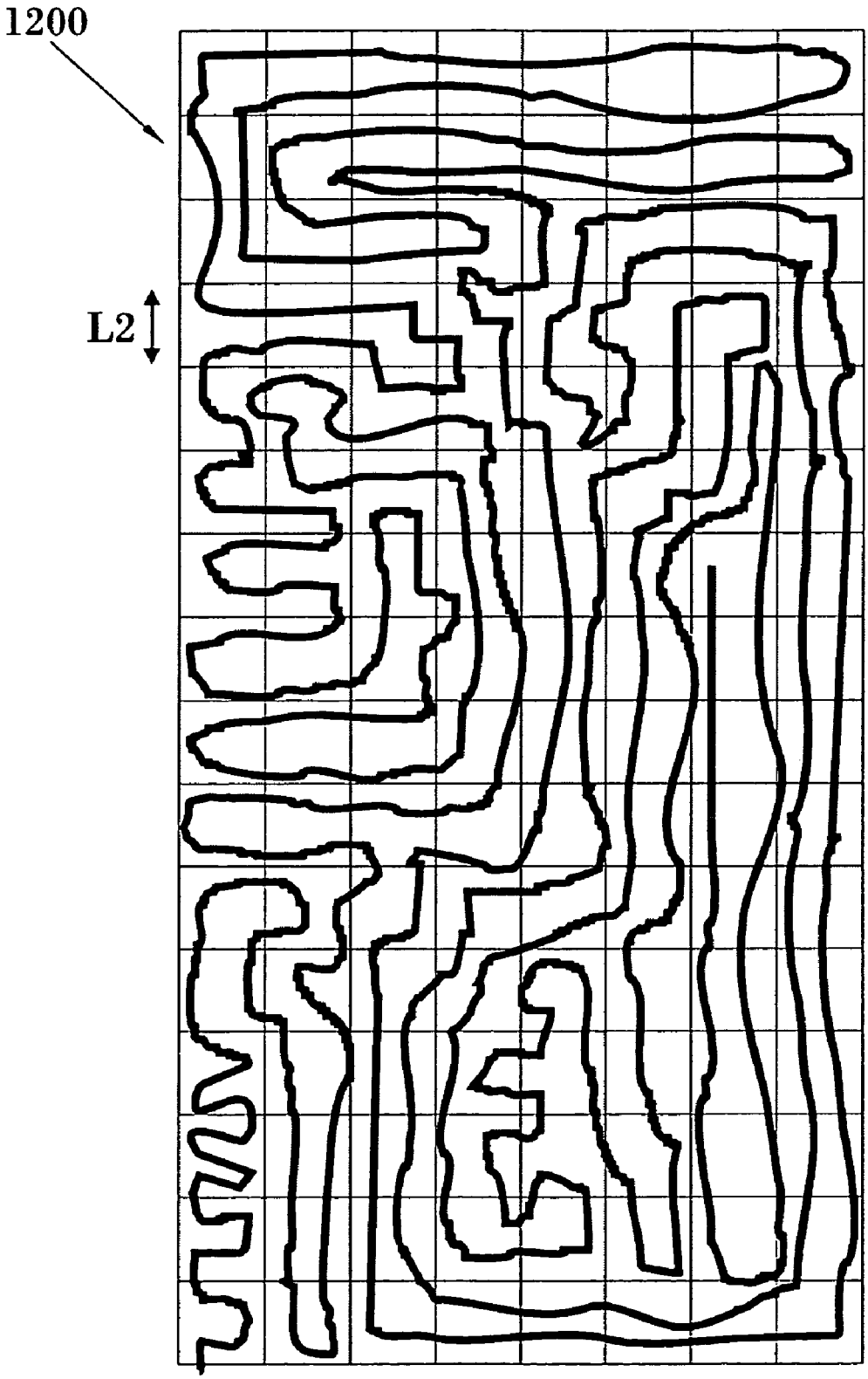
Figure 13:
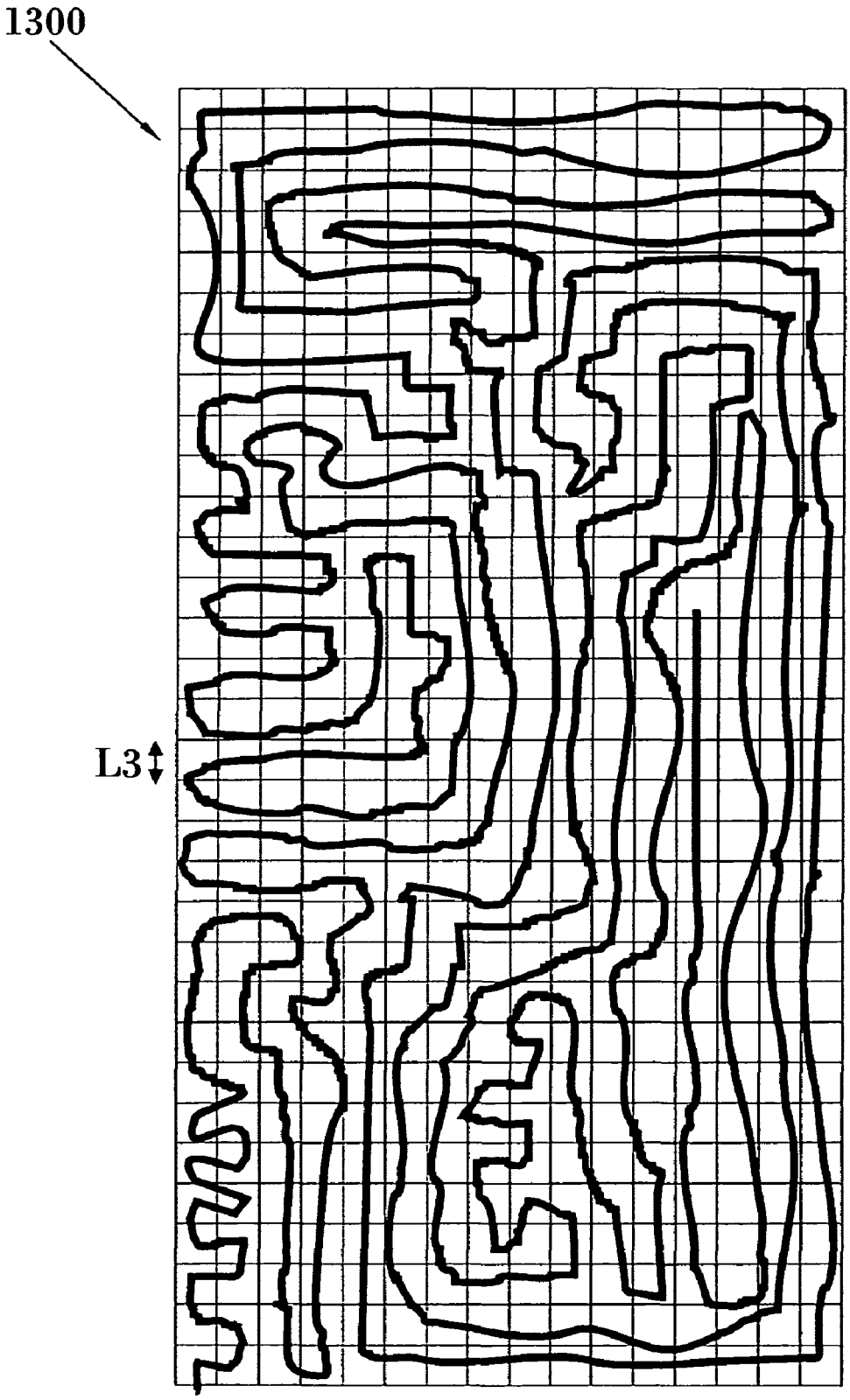

An example of a grid-dimension curve is given in FIG. 10. In FIG. 11 it is shown how this curve of FIG. 10 is placed in a 4×8 grid with 32 cells. The curve crosses all 32 cells and therefore N1=32. In FIG. 12 the curve of FIG. 10 is shown in combination with an 8×16 grid with 128 cells. The curve crosses all 128 cells and therefore N2=128. The resulting grid-dimension is therefore 2. In FIG. 13 the curve of FIG. 10 is shown placed in a 16×32 grid with 512 cells. The curve crosses at least one point of 509 cells.

Multilevel Structures

In some examples, at least a portion of the conducting trace, conducting wire or conducting sheet of the antenna may be coupled, either through direct contact or electromagnetic coupling, to a conducting surface, such as a conducting polygonal or multilevel surface. Further the curve of the antenna may include the shape of a multilevel structure. A multilevel structure is formed by gathering several geometrical elements, such as polygons or polyhedrons, of the same type or of different type (e.g., triangles, parallelepipeds, pentagons, hexagons, circles or ellipses as special limiting cases of a polygon with a large number of sides, as well as tetrahedral, hexahedra, prisms, dodecahedra, etc.) and coupling electromagnetically at least some of such geometrical elements to one or more other elements, whether by proximity or by direct contact between elements.

At least two of the elements may have a different size. However, also all elements may have the same or approximately the same size. The size of elements of different a type may be compared by comparing their largest diameter.

The majority of the component elements of a multilevel structure have more than 50% of their perimeter (for polygon and surface like elements) or their surface (for polyhedrons) not in contact with any of the other elements of the structure. Thus, the component elements of a multilevel structure may typically be identified and distinguished, presenting at least two levels of detail: that of the overall structure and that of the polygon or polyhedron elements that form it. Additionally, several multilevel structures may be grouped and coupled electromagnetically to each other to form higher-level structures. In a single multilevel structure, all of the component elements are polygons with the same number of sides or are polyhedrons with the same number of faces. However, this characteristic is not present when several multilevel structures of different natures are grouped and electromagnetically coupled to form meta-structures of a higher level.

A multilevel antenna includes at least two levels of detail in the body of the antenna: that of the overall structure and that of the majority of the elements (polygons or polyhedrons) which make it up. This may be achieved by ensuring that the area of contact or intersection (if it exists) between the majority of the elements forming the antenna is only a fraction of the perimeter or surrounding area of said polygons or polyhedrons.

One example property of multilevel antennae is that the radioelectric behavior of the antenna can be similar in more than one frequency band. Antenna input parameters (e.g., impedance) and radiation pattern remain similar for several frequency bands (i.e., the antenna has the same level of adaptation or standing wave relationship in each different band), and often the antenna presents almost identical radiation diagrams at different frequencies. The number of frequency bands is proportional to the number of scales or sizes of the polygonal elements or similar sets in which they are grouped contained in the geometry of the main radiating element.

In addition to their multiband behavior, multilevel structure antennae may have a smaller than usual size as compared to other antennae of a simpler structure (such as those consisting of a single polygon or polyhedron). Additionally, the edge-rich and discontinuity-rich structure of a multilevel antenna may enhance the radiation process, relatively increasing the radiation resistance of the antenna and reducing the quality factor Q (i.e., increasing its bandwidth).

A multilevel antenna structure may be used in many antenna configurations, such as dipoles, monopoles, patch or microstrip antennae, coplanar antennae, reflector antennae, wound antennae, antenna arrays, or other antenna configurations. In addition, multilevel antenna structures may be formed using many manufacturing techniques, such as printing on a dielectric substrate by photolithography (printed circuit technique); dieing on metal plate, repulsion on dielectric, or others.

SUMMARY OF THE INVENTION

The invention relates the antennas, devices and methods as defined in the independent claims. Certain embodiments of the invention are defined in the dependent claims.

One aspect of the present invention relates to an antenna for a handset, and generally for any wireless device (such as for instance a mobile phone, a smartphone, a PDA, an MP3 player, a headset, a USB dongle, a laptop, a PCMCIA or Cardbus 32 card), wherein the said antenna features at least one inner spring contact.

An antenna comprising at least one inner spring contact according to the present invention has a geometry that defines one or more gap, opening or empty space within the body of the antenna in a way that the unfolded strip of a spring contact fits completely inside the said gap, opening or empty space, such that:

- the minimum rectangular area of the antenna before and after bending the strip of the spring contact is approximately the same, so that a compact stamping area is obtained (i.e., minimal stamping area overhead); and
- the region of connection of the spring contact with the main body of the antenna is substantially close to the perimeter of the minimum rectangular area of the main body of the antenna, so that the antenna can be mounted on the PCB in such a way that the antenna can be fed close to the edge of the PCB.

Basically, in accordance with one aspect of the invention, the antenna comprises a main body of the antenna and at least one strip extending from said main body for constituting (for example, after having been bent with regard to the main body so as to extend more or less orthogonally with respect to said main body) a contact element (such as a spring contact element) for connecting the main body to at least one element of said wireless device (for example, to ground or to a feeding pad or similar), both of said at least one strip and said main body being formed out of the same plate of electrically conductive material. The antenna is configured so that when said metal plate is made flat with said at least one strip and said antenna body in the same plane (that is, for example, adopting the shape that it has or had immediately after stamping an original metal plate so as to define the outline of the antenna):

- a "first area" (namely, the "antenna total area") that is an area of the smallest possible rectangle that encompasses the perimeter of the main body and that of said at least one strip, and a "second area" (namely, the antenna body area) that is an area of the smallest possible rectangle that encompasses the perimeter of the main body, are identical, thus providing for substantially zero stamping area overhead);
- said main body has, within said second area, at least one gap (or opening, or empty space) in said main body, said at least on strip extending into said gap from an edge of said main body that delimits said gap (thus making it possible to have rather long strips while having the strips extending from a position close to a perimeter of the main body and/or of the antenna body area);
- at least one of said strips having a free end facing, in a longitudinal direction of said strip, an edge of said main body that delimits said gap (that is, the strip is substantially placed "within" the gap and at least partly surrounded by the main body).

Thus, "inner" spring contacts are obtained, obviating the above-mentioned drawbacks of prior art antenna structures. For example, when using the inner spring contacts, the strips can be made long while at the same time being arranged to extend from the main body at a position close to the perimeter of the main body or of the antenna body area, allowing the antenna to be suitably placed on a printed circuit board or ground-plane, with the spring contacts or similar in contact with said printed circuit board or ground-plane at one or more positions close to the relevant perimeter of said printed circuit board or ground-plane, and without the main body of the antenna (or antenna body area) extending beyond said printed circuit board or ground-plane.

The invention also makes it possible to always arrange the spring contacts close to the perimeter of the main body or of the antenna body area, thus making it possible to feed the antenna and/or connect it to ground, for example, at a position close to said perimeter. This can be advantageous for obtaining an adequate antenna input impedance and/or for obtaining an adequate distribution of currents in the antenna and/or lowering the resonant frequency.

Said at least one gap can be completely surrounded by electrically conductive material of said main body, so that said gap is an internal gap within said main body (for example, not communicating with the external perimeter of the main body or doing so through some kind of channel), said at least one strip, when arranged in the same plane as said main body, being entirely housed within said gap. However, in some embodiments, the gap is not completely surrounded by conductive material of said main body, and one or more of said strips can have a free end that is not facing, in a longitudinal direction of said strip, any edge of said main body that delimits said gap.

Said at least one strip can comprise a plurality of strips, each strip extending from said main body for constituting a contact element for connecting the main body to at least one element of said wireless device. These strips can be housed in the same or different gaps.

Said at least one strip can be connected to the main body at a point of transition between said main body and said strip, at an edge of said main body delimiting said gap, wherein said point of transition is placed at a small distance from the perimeter of said second area or from the perimeter of the main body. In this context, "small distance" can be a distance of less than X % of the extension of said second area in the longitudinal direction of the strip, X being less than 25, 20, 15 or 10, or even 5. As an alternative, "small distance" can be a distance of less than Y % of the length of the shortest side of said second area (that is, the antenna body area), Y being less than 25, 20, 15, or 10, or even less than 5.

Another aspect of the invention relates to an antenna for a wireless device, said antenna comprising a main body of the antenna and at least one strip extending from said main body for constituting a contact element for connecting the main body to at least one element of said wireless device, both of said at least one strip and said main body being formed out of the same plate of electrically conductive material, wherein the antenna is configured so that when said metal plate is made flat with said at least one strip and said antenna body in the same plane:

- a first area (the antenna total area) being an area of the smallest possible rectangle that encompasses the perimeter of the main body and that of said at least one strip, and a second area (the antenna body area) being an area of the smallest possible rectangle that encompasses the perimeter of the main body, are identical;
- said main body has, within said second area, at least one gap (or opening, or empty space) in said main body, said at least on strip extending into said gap from an edge of said main body that delimits said gap;

wherein said at least one strip is connected to the main body at a point of transition between said main body and said strip, at an edge of said main body delimiting said gap, wherein said point of transition is placed at a small distance from the perimeter of said second area.

Said small distance can a distance of less than X % of the extension of said second area in the longitudinal direction of the strip, X being less than 25, 20, 15 or 10, or even less than 5. As an alternative, said small distance can be a distance of less than Y % of the length of the shortest side of said second area, Y being less than 25, 20, 15 or 10, or even less than 5.

In some embodiments in accordance with this aspect of the invention, none of said strips has a free end that is facing, in a longitudinal direction of said strip, an edge of said main body that delimits said gap.

Further aspects of some embodiments are described below and/or defined in dependent claims.

When there is more than one strip, the strips can be parallel or not (for example, they can extend perpendicularly to each other). The strips can extend from the same edge of the gap, or from different edges. The strips can even extend from opposite edges and/or extend in contrary directions. The strips can have the same or different lengths. That is, the strips can be arranged in many ways, depending on design restrictions such as the position of the landing area and/or contact pads that should be contacted by the strips in order to establish connection with the antenna (such as connection for feeding the antenna and/or for grounding it).

In many embodiments of the antenna, the strips will initially extend from said edge of said main body towards a more central portion of said main body, that is, "inwards" from the perimeter of the antenna body.

In many embodiments of the antenna, the antenna does not comprise any capacitive loads formed by bended perimetric portions of said main body. Due to the way the strips extend "inwards", bending such perimetric portions is not any longer necessary in order to have the spring contacts extend downward towards their landing areas at a position close to the perimeter of the antenna body area.

Another aspect of the invention relates to a method for contacting the antenna by means of an inner spring contact.

A further aspect of the invention is related to a wireless device including an antenna as described above. The antenna can be mounted on a printed circuit board or ground plane of said wireless device, and said at least one strip can be in contact with said printed circuit board at an area of connection at a small distance from an edge of said printed circuit board or ground plane. Said "small distance" can be a distance of less than Z % of the length of the printed circuit board, Z being less than 10, less than 5 or even less than 3 or 1.

On the other hand, the orthogonal projection of the main body of the antenna on the printed circuit board can be entirely within the perimeter of said printed circuit board.

On the other hand, the wireless device can include at least one component arranged on said printed circuit board in correspondence with said gap so that said component is accessible through said gap (once the strips have been bent). This is useful for providing for a more efficient use of the PCB area. Typical examples of components that can be placed in this way are a radio frequency connector and an objective of a camera such as a digital camera.

A further aspect of the invention relates to the technique to increase the density of components in the handset or wireless device by integrating underneath the antenna components of the said handset or wireless device that can be accessed from the outside through the gaps, openings or empty spaces in the main body of the antenna left after folding the strip of the spring contact.

LIST OF FIGURES

Further characteristics and advantages of the invention will become apparent in view of the detailed description which follows of some preferred embodiments of the invention given for purposes of illustration only and in no way meant as a definition of the limits of the invention, made with reference to the accompanying drawings, in which:

FIG. 1—Example of an antenna for a handset or wireless device comprising spring contacts that protrude towards the outside of the main body of the antenna: (a) Top view of a flat plate of conductive material with the shape of the antenna comprising the strips of the spring contacts; and (b) perspective view of the antenna after folding the strips of the spring contacts.

FIG. 2—Example of an antenna for a handset or wireless device comprising spring contacts that protrude towards the outside of the main body of the antenna but having a antenna total area approximately equal to the antenna body area: (a) Top view of a flat plate of conductive material with the shape of the antenna comprising the strips of the spring contacts; and (b) perspective view of the antenna after folding the strips of the spring contacts and some portions of the antenna.

Figure 3:
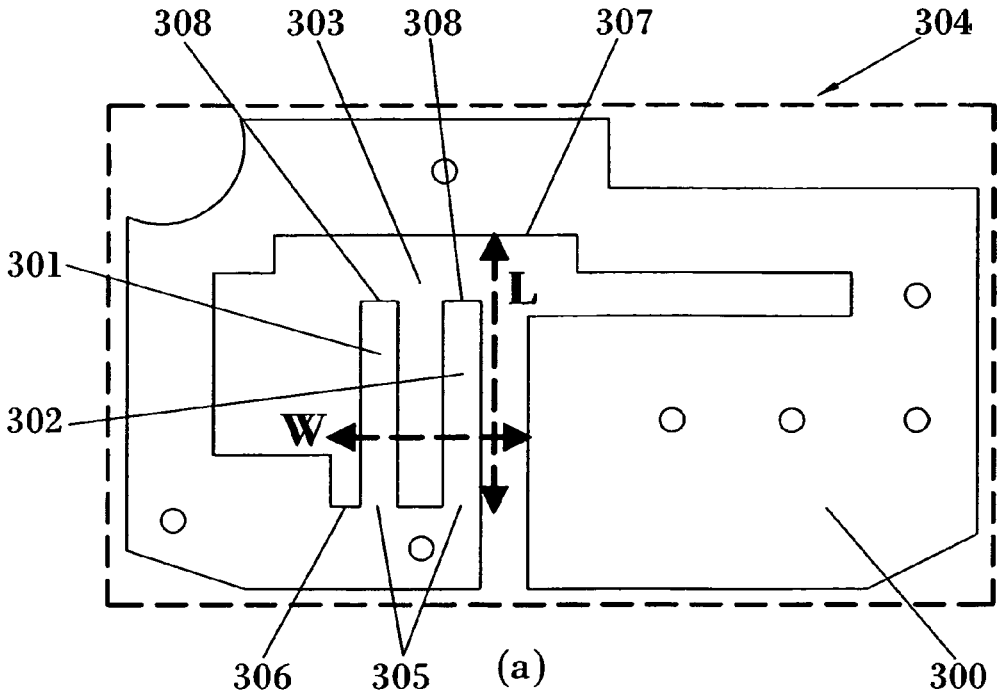
Figure 3:
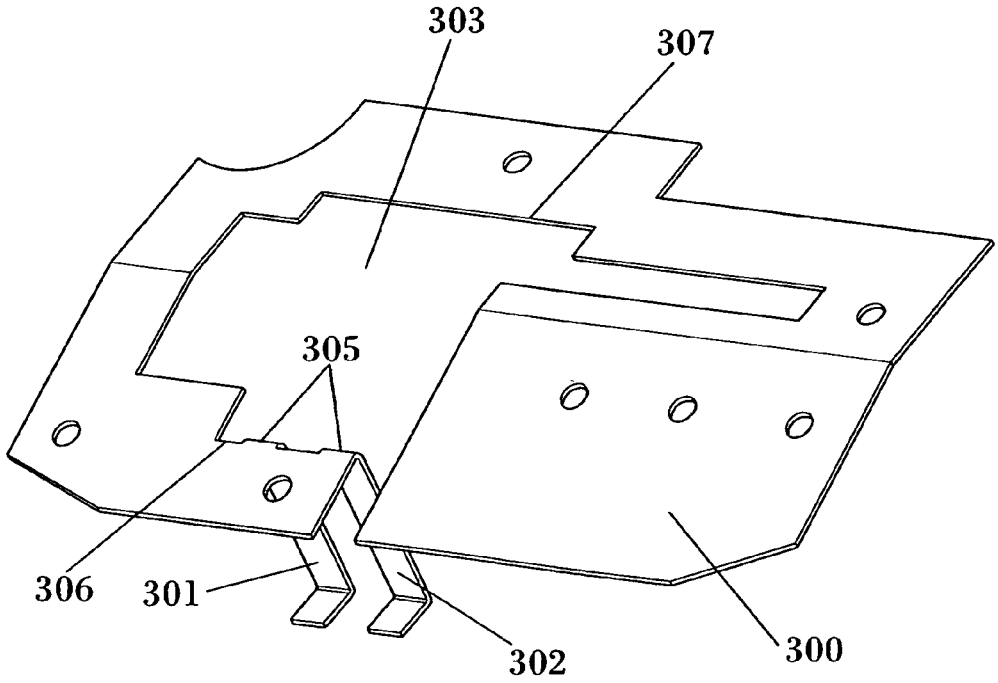

FIG. 3—Example of an antenna for a handset or wireless device comprising inner spring contacts according to the present invention: (a) Top view of a flat plate of conductive material with the shape of the antenna comprising the strips of the spring contacts; and (b) perspective view of the antenna after folding the strips of the spring contacts.

Figure 4:
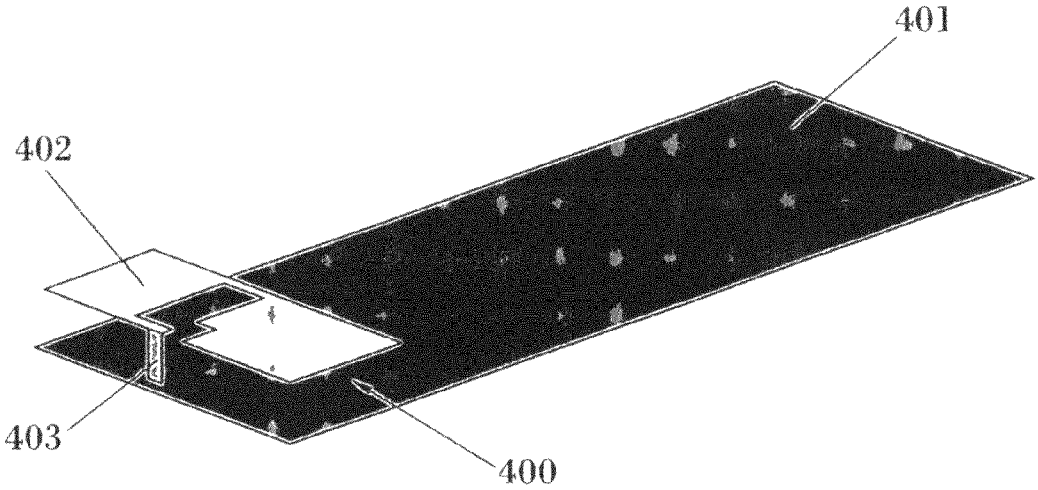

FIG. 4—Example of a patch antenna with an inner spring contact mounted on a PCB of a mobile handset with the dimensions 100 mm×40 mm.

Figure 5:
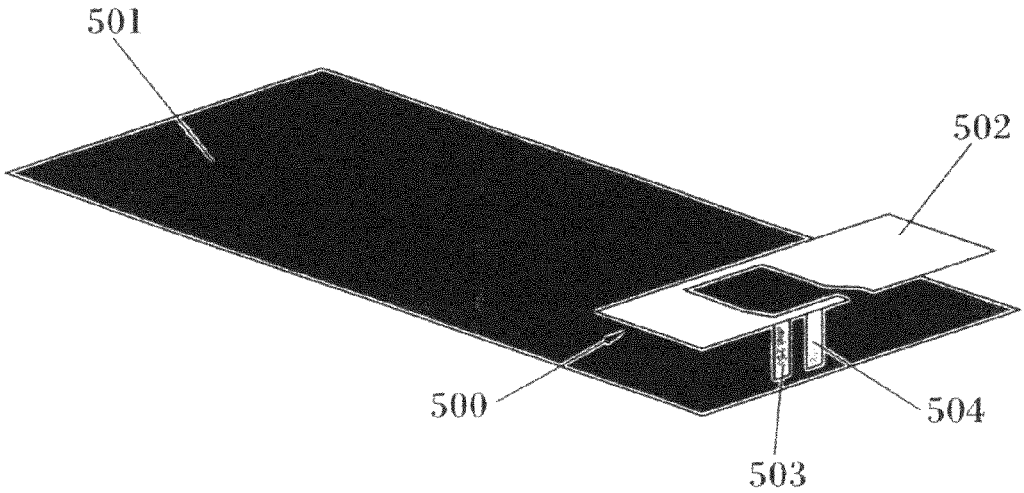

FIG. 5—Example of a PIFA with two inner spring contacts mounted on a PCB of a mobile handset with the dimensions 100 mm×40 mm.

Figure 6:
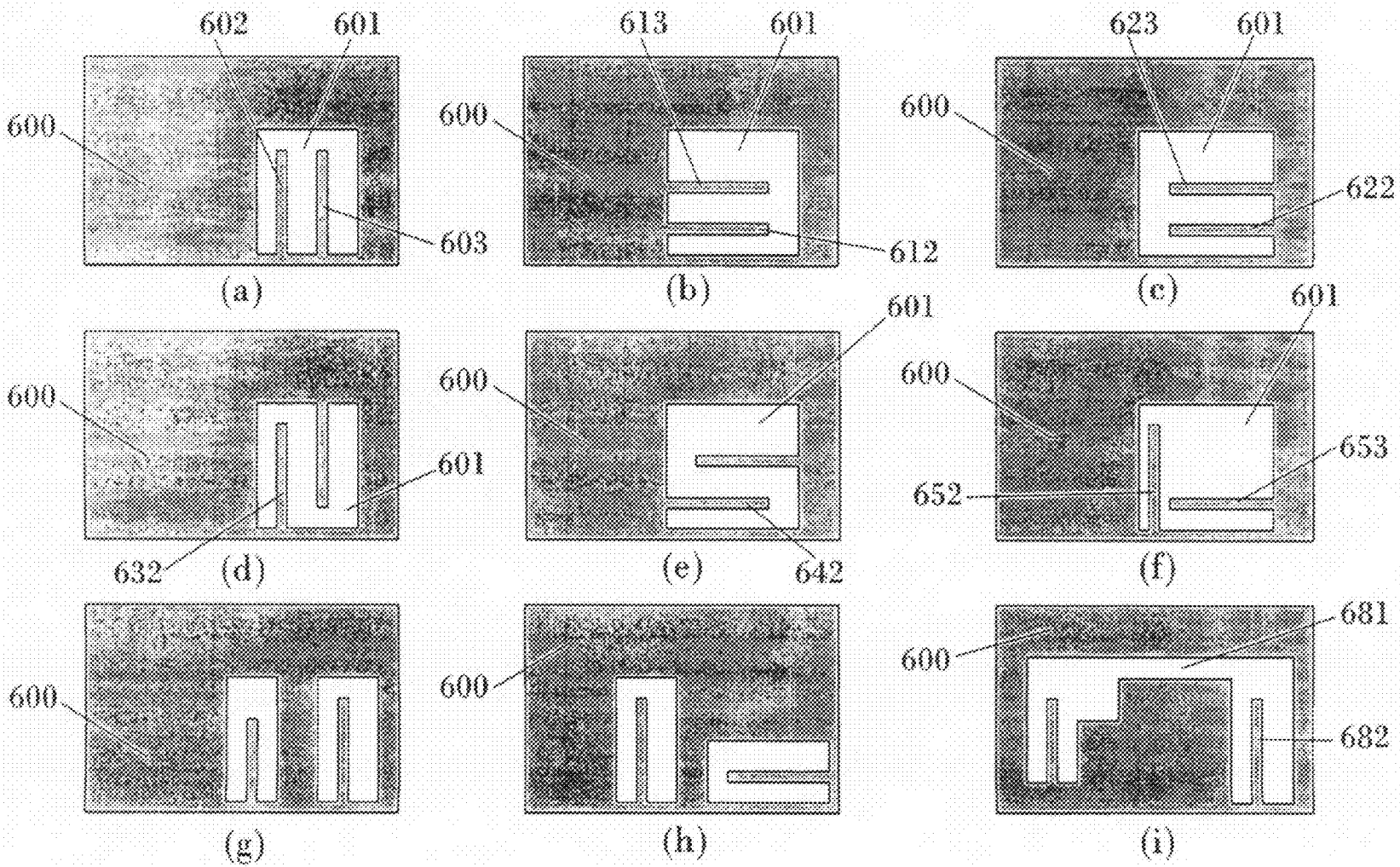

FIG. 6—Examples of an antenna according to the present invention comprising two unfolded inner spring contacts arranged in an opening within the structure of the main body of the antenna.

Figure 7:
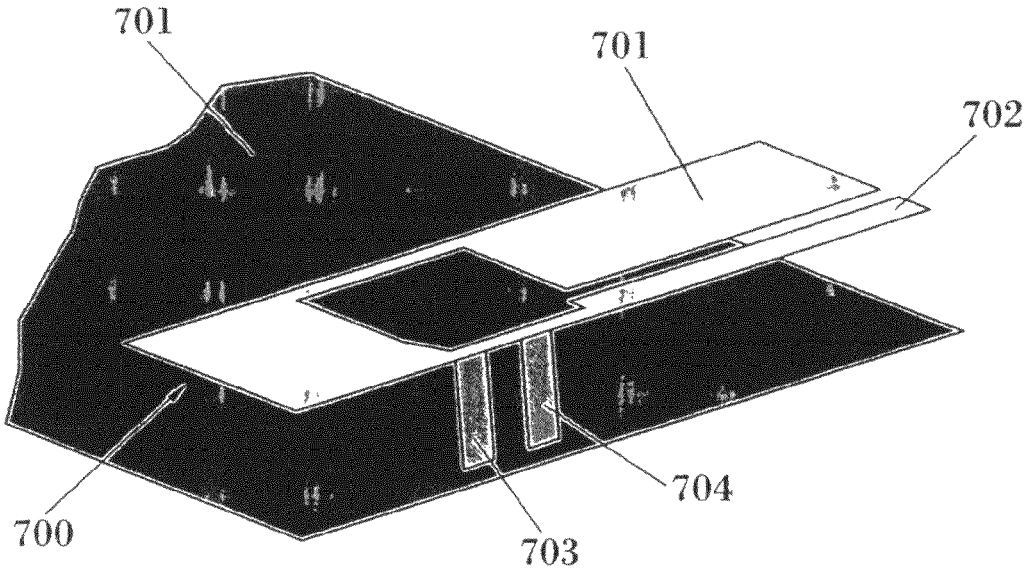
Figure 7:
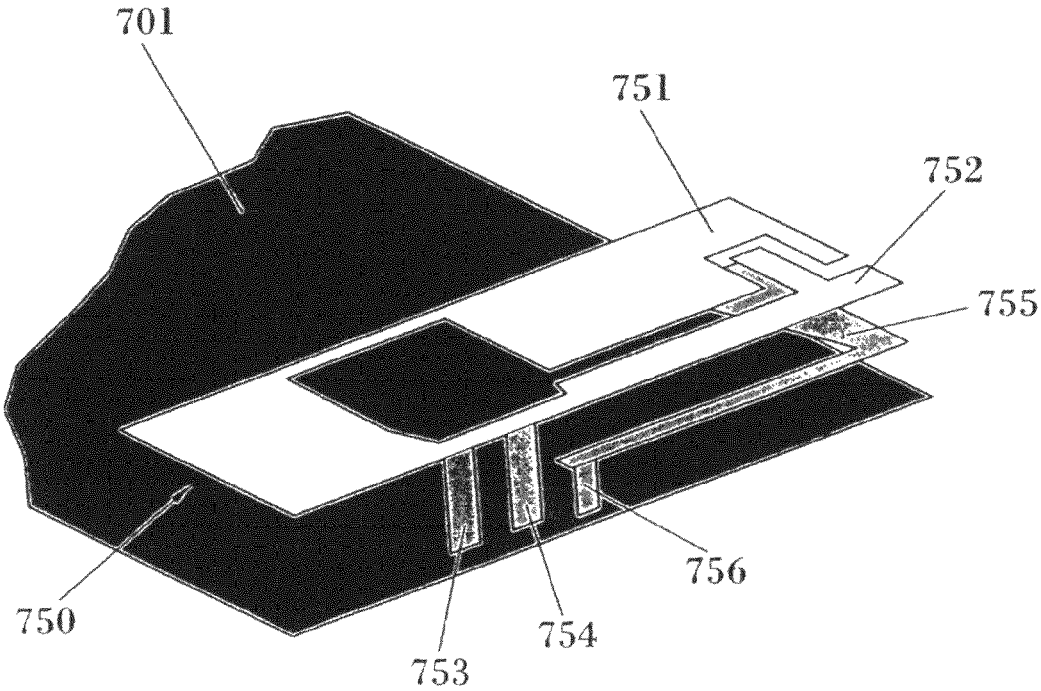

FIG. 7—Examples of multiband antennas according to the present invention comprising two inner spring contacts: (a) Multiband antenna comprising one single element including inner spring contacts; and (b) multiband antenna comprising an electrically driven element and a parasitic element both including inner spring contacts.

Figure 8:
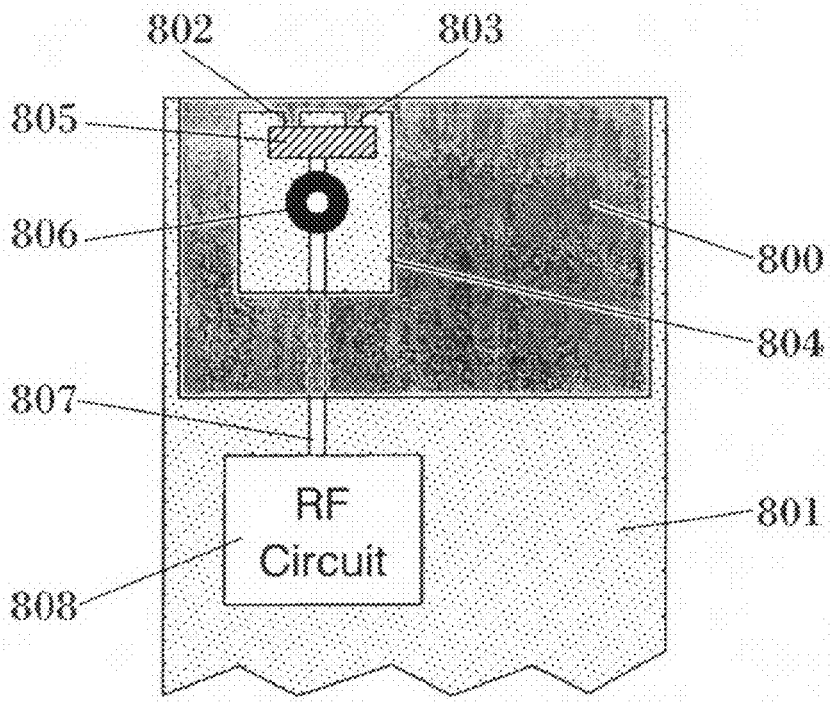
Figure 8:
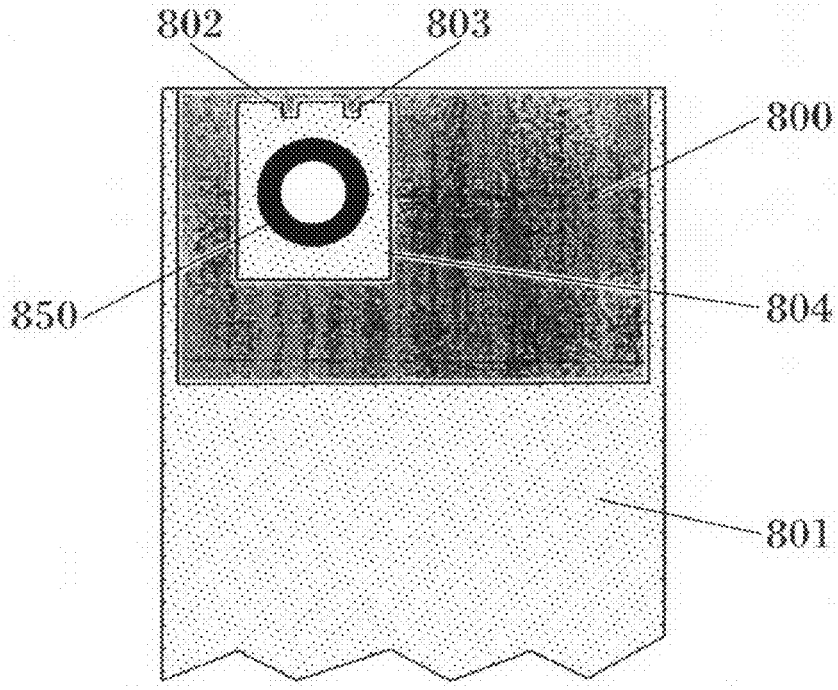

FIG. 8—Examples of the higher integration capabilities of components on the PCB of a handset using an antenna with inner spring contacts according to the present invention: (a) Integration of a RF connector in the opening defined in the geometry of the antenna; and (b) integration of an objective of a digital camera in the opening defined in the geometry of the antenna.

FIG. 9—Example of how to calculate the box counting dimension.

FIG. 10—Example of a curve featuring a grid-dimension larger than 1, referred to herein as a grid-dimension curve.

FIG. 11—The curve of FIG. 18 in the 32 cell grid, wherein the curve crosses all 32 cells and therefore N1=32.

FIG. 12—The curve of FIG. 18 in a 128 cell grid, wherein the curve crosses all 128 cells and therefore N2=128.

FIG. 13—The curve of FIG. 18 in a 512 cell grid, wherein the curve crosses at least one point of 509 cells.

Figure 14:
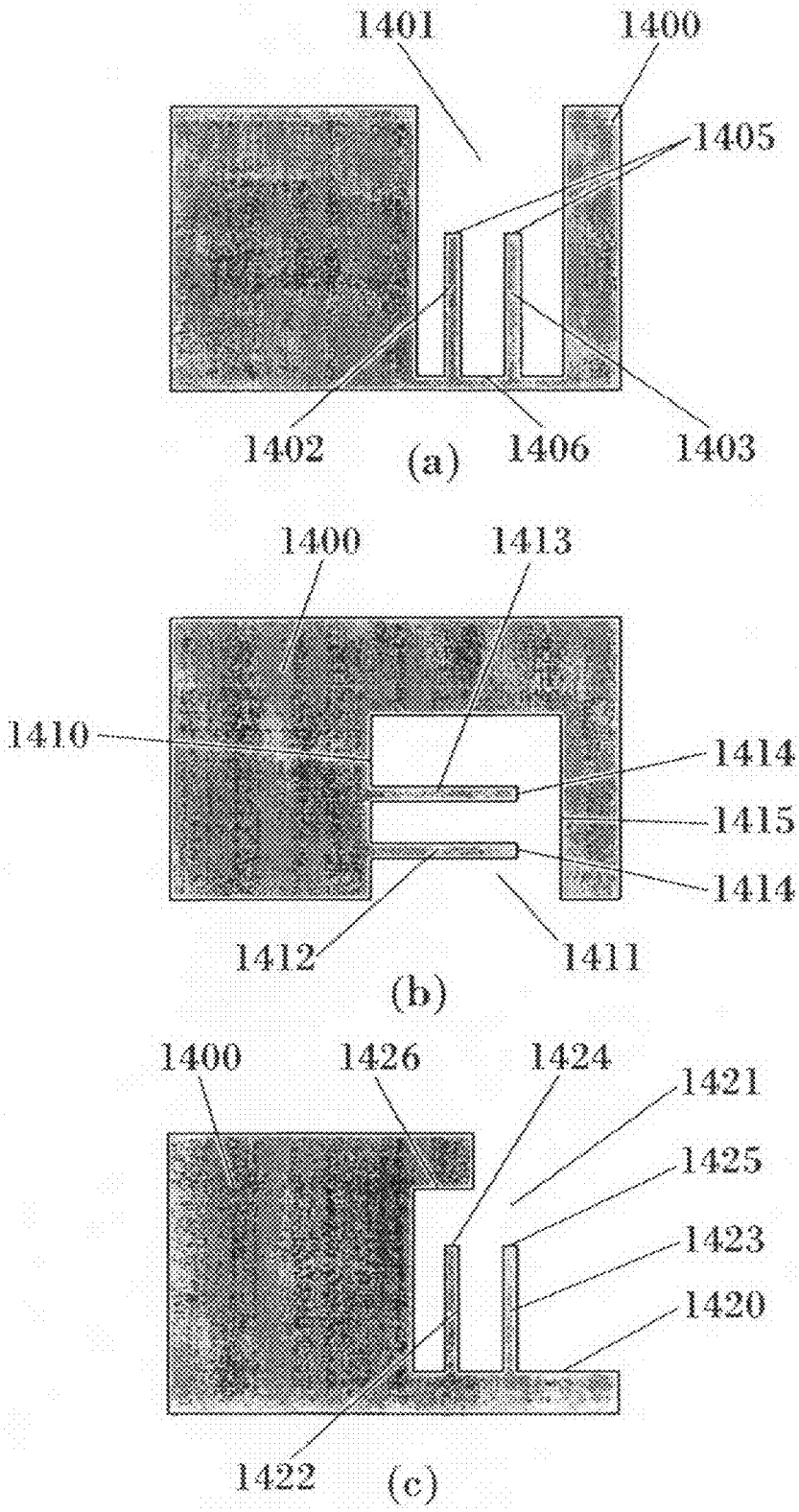

FIG. 14—Examples of an antenna according to the present invention comprising two unfolded inner spring contacts arranged in an empty space within the structure of the main body of the antenna, wherein the said empty space is not completely surrounded by the conductive material of the antenna.

DESCRIPTION OF THE PREFERRED EMBODIMENTS

FIG. 3 shows a preferred embodiment of an antenna for a handset including at least one inner spring contact according to the present invention. The antenna in FIG. 3 comprises a main body (300) and two strips (301, 302). FIG. 3*a* shows the shape of the antenna as a flat plate of conductive material after the stamping process has taken place. The strips (301,302) are unfolded and coplanar to the main body of the antenna (300). In FIG. 3*b*, the said strips (301, 302) have been folded and shaped into spring contacts. In some cases the antenna of the FIG. 3 will be mounted on a plastic carrier, while in other cases the antenna will be affixed to the plastic cover of the handset.

According to the present invention, the main body of the antenna (300) defines empty spaces within its extension, such as for example the region or gap (303), in which the unfolded strips for the spring contacts (301, 302) can be placed. The rectangle (304) is the smallest possible rectangle that encloses the perimeter of the main body of the antenna (300). Furthermore, the rectangle (304) is also the smallest possible rectangle that encloses the perimeter of the main body of the antenna (300) and that of the strips of the spring contacts (301, 302). Therefore, the flat shape of the antenna disclosed in FIG. 3*a* has an antenna total area equal to the antenna body area, and hence there is no stamping area overhead.

The size of the openings, gaps, or empty spaces defined within the extension of the main body of the antenna must be large enough to house the unfolded strips of the spring contacts. The length of an unfolded strip of a spring contact comprises the length corresponding to the height of the antenna with respect to the PCB on which the antenna is mounted, and, normally, the additional length necessary to provide the bends to the strips to shape the spring contacts.

An opening, gap or empty space within the extension of the main body of the antenna must have a length larger than the length of an unfolded strip of a spring contact, and a width larger than the width of the strip of the spring contact. In the context of this application the length of a gap, opening or empty space is defined as being the linear dimension parallel to a longest side of the strip of the spring contact contained in the said gap, opening, or empty space. In the same way, the width of a gap, opening or empty space is defined as being the linear dimension perpendicular to a longest side of the strip of the spring contact contained in the said gap, opening, or empty space. For example in FIG. 3*a*, L denotes the length of the empty region (303), while W is the width of the empty region (303).

In some embodiments, the length of a gap, opening or empty space containing an inner spring contact will be preferably larger than a minimum value selected from the group of minimum values including 2 mm, 4 mm, 6 mm, 8 mm, 10 mm, 11 mm, 12 mm, 13 mm, 14 mm, 15 mm, 16 mm, 18 mm, and 20 mm. In some examples, the width of a strip of a spring contact will be in the range from approximately 0.5 mm to approximately 4 mm, including any subinterval of said range.

Additionally, the strips of the spring contacts (301, 302) are connected to the main body of the antenna (300) in region or "point of transition" (305), which is substantially close to the perimeter of the minimum rectangular area of the main body of the antenna, in this case the bottom edge of the rectangle (304). As a result, after folding the strips of the spring contacts (301, 302), as shown in FIG. 3*b*, the landing area of the spring contacts on a PCB can be substantially close to an edge of the said PCB. In some embodiments, the distance between a landing area of a spring contact on a PCB and an edge of the said PCB is preferably smaller than, or approximately equal to, a maximum value selected from the group of maximum values including 1 mm, 2 mm, 3 mm, 4 mm and 5 mm. Said distance can typically be less than 25, 20, 15, 10 or 5% of the dimension of the rectangle (304) in the direction of the strip, or of the longest and/or shortest side of the strip. The distance can be counted from the region or point of transition (305) between the main body (300) and the strips (301, 302), that takes place at an edge (306) of the main body that delimits the gap. On the other hand, the free ends (308) of the both strips (301, 302) are facing an opposite edge (307) of the main body that delimits the same gap. When the strips are bent to extend orthogonally with respect to the general plane of the main body (300), the bend is substantially corresponding to said point or region of transition (305), as shown in FIG. 3*b*.

In some cases, four edges of a strip of the spring contact will be surrounded by the conductive material of the main body of the antenna. In other cases three edges, or even just two edges, of the said strip will be surrounded by the conductive material of the main body of the antenna. For example, in FIG. 3*a*, both strips (301, 302) have four edges surrounded by the conductive material of the main body of the antenna (300). One of the said four edges of the strips (301, 302) is in direct contact with the main body of the antenna (300) in region (305).

FIG. 14 discloses some examples of an antenna in which the strips of the spring contacts are placed in an opening (1401, 1411, 1421) defined within the structure of the main body of the antenna (1400), and in which the said opening (1401, 1411, 1421) is not completely surrounded by the conductive material of the antenna. In FIGS. 14*a* and 14*b*, the strips (1402, 1403, 1412, 1413) have three of their edges surrounded by the conductive material of the main body of the antenna (1400). In FIG. 14*c*, one of the strips (1422) has three of its edges surrounded by the conductive material of the main body of the antenna (1400), while the other strip (1423) is surrounded by the conductive material of the main body of the antenna (1400) in only two of its edges.

That is, in FIG. 14*a*, the strips extend from an edge (1406) of the main body (1400) of the antenna, but the free ends (1405) of said strips, in a longitudinal direction of said strips, are not facing any edge of the main body that delimits said gap, but rather face an opening where said gap (1401) communicates with the exterior (that is, they are not facing conductive material of said main body).

In FIG. 14*b*, however, both strips (1412) and (1413) extend from an edge (1410) of the main body that delimits said gap (1411), and the free ends (1414) of said strips face an opposite edge (1415) of said main body, delimiting said gap.

In FIG. 14*c*, the free end (1424) of one of the strips (1422) extending from the edge (1420) of the main body delimiting the gap faces, in the longitudinal direction of the strip, an opposite edge (1426) of said main body delimiting the gap (1421), whereas the free end (1425) of the other strip (1423) does not face said opposite edge (1426).

In some embodiments, the antenna will have only one spring contact according to the present invention. In these cases the spring contact can typically be used to feed the antenna. In some other preferred embodiments, the antenna will have two or more spring contacts. In these other cases, one of the spring contacts will typically serve to feed the antenna, while the other spring contact (or other spring contacts) can be used to connect the antenna to the ground plane of the PCB, which can be advantageous to have a better control over the input impedance of the antenna, to miniaturize the antenna, or a combination of these effects.

According to the present invention, in some cases an antenna with only one spring contact can be advantageous, being some of the reasons:

- Reduction of the mechanical complexity of the antenna, aspect that can be especially interesting for single-band antennas.
- Making the design more robust to dimensional tolerances.
- Decreasing the chances of malfunctioning of the antenna because of a loss of electrical continuity (e.g., an air gap) between the spring contact with its landing area (or pad) on the PCB, which makes for example the antenna more reliable in a drop test.
- Requiring fewer pads for the landing area of the spring contacts, which results in more space available to other components on the PCB.

FIG. 4 presents an embodiment of an antenna (400), with one inner spring contact (403) according to the present invention, mounted on a PCB (401) that has some typical dimensions of a mobile handset (such as 100 mm×40 mm). In this particular example, the antenna (400) takes the form of a patch antenna and comprises a main body (402) placed at a certain height over the ground plane of the PCB (400), and a spring contact (403) that is used to feed the antenna (400). The antenna (400) is mounted on the PCB (401) in such a way that the landing area of the spring contact (403) is substantially close to an edge of the PCB (401). In this particular example, and in no way meant to be a limitation of the invention, the geometry of the antenna (400) has been designed to operate at a single band, providing coverage for the GSM850 communication service.

Another embodiment of an antenna with inner spring contacts is shown in FIG. 5. In this case, the antenna (500) has two inner spring contacts (503, 504) mounted on the PCB (501) of a handset. One of these spring contacts (503) is used to feed the antenna, while the other spring contact (504) is connected to the ground plane of the PCB (501). In this particular case, the antenna (500) is a planar inverted-F antenna (PIFA), and the geometry of the antenna has been designed to operate in the GSM850 band.

In some cases the use of such an antenna might require a matching network to increase, for instance, the impedance bandwidth. The matching network might include one or more elements (such as for example inductors, capacitors, resistors, or jumpers). The matching network can have any type of topology with elements being connected in parallel and in series, forming, for example, L-shaped (i.e., parallel-series or series-parallel) networks or Π-shaped (parallel-series-parallel) networks. In some other cases, embodiments in which there is one or more spring contacts that connect the antenna to the ground plane of the PCB can be advantageous as it might make a matching network unnecessary.

Some preferred examples of an antenna with inner spring contacts are presented in FIG. 6. The figure presents a top view of a flat plate of conductive material which, by means of a stamping process, has been given the shape of an antenna comprising two strips to be used as spring contacts. Without limitation, the number of spring contacts could have been selected to be another number.

In the cases depicted in FIGS. 6*a*, 6*b*, and 6*c*, the two strips of the spring contacts (602, 603, 612, 613, 622, 623) are connected on the same edge of the opening (601) created in the main body of the antenna (600). The embodiments shown in FIGS. 6*d*, 6*e* and 6*f* correspond to cases in which not all the strips of the spring contacts are connected to the main body of the antenna (600) on the same edge of the opening (601). Moreover, FIG. 6*f* discloses the case in which the strips (652, 653) are not parallel. FIGS. 6*g* and 6*h* present some cases in which the main body of the antenna (600) includes more than one opening within its extension, and in which not all the strips of the spring contacts are placed inside the same opening. In some cases (see FIGS. 6*g* and 6*i*), the antenna comprises strips of different lengths. FIG. 6*i* shows an antenna whose main body (600) has an opening of an arbitrary shape (681). It can be advantageous in some cases to use the strip that is closer to the external perimeter of the antenna (612, 622, 632, 642, 652, 682) as the spring contact for feeding purposes, as this can be placed closer to an edge of the PCB on which the antenna is mounted.

In some cases the antenna will be able to operate simultaneously at two, three, or more bands. FIG. 7*a* shows an embodiment of an antenna (700) mounted on a PCB (701), wherein the antenna (700) comprises two inner spring contacts (703, 704). One of said two spring contacts (703, 704) is for feeding purposes, while the other one connects the antenna (700) to the ground plane of the PCB (701). In this case, the antenna (700) is capable of a multiband behavior. The openings in the geometry of the antenna (700), creating the geometric elements (701) and (702), make it possible for the antenna to support more resonance modes and operate in different frequency bands (such as for instance GSM900 and GSM1800).

In certain examples, the antenna will comprise only one element made of conductive material, while in some other examples the antenna will comprise two or more elements. The latter arrangements can be advantageous to create parasitic elements to enhance the antenna performance. When the antenna comprises more than one element of conductive material, one or more of said elements can include a spring contact. In these cases, at least one of the elements of the antenna will have an inner spring contact according to the present invention. FIG. 7*b* presents another example of a multiband antenna with inner spring contacts. As in the case of FIG. 7*a*, the openings in the geometry of the antenna (750), creating the geometric elements (751) and (752), make it possible for the antenna (750) to exhibit multiple band behavior. In this case, the antenna (750) comprises another conductive element (755) that is connected to the ground plane of the PCB (701), by means of a spring contact (756). In this particular example the spring contacts of the electrically driven element (753, 754), and that of the parasitic element (756) are inner spring contacts according to the present invention.

In some embodiments the parasitic element (755) will be coplanar to the electrically driven element of the antenna (750). A parasitic element is advantageous in enhancing the electrical behavior of the antenna. Coplanar parasitic element would be preferred to simplify the design of the carrier of the antenna, further reducing the cost of the antenna.

Another aspect of the invention relates to the higher capability for integration of components underneath the antenna and that need to be accessible from the outside (such as for instance, but not limited to, a RF test connector, or a camera). Once the strips of the spring contacts have been folded, the space occupied by the unfolded strips of the spring contacts inside the gaps, openings or empty spaces created within the extension of the main body of the antenna becomes available for the placement of other electrical or mechanical components carried by the PCB. For example, in FIG. 3*a*, the unfolded strips of the spring contacts (301, 302) occupy a substantial portion of the opening (303), that becomes available for the placement of other components when the strips of the spring contact (301, 302) are given their final shape.

FIG. 8 presents a couple of examples of how a higher level of integration of the components carried by the PCB of a handset or a wireless device can be obtained by means of an antenna with inner spring contacts. FIGS. 8*a* and 8*b* show a top view of a PCB (801) comprising an antenna (800) with two inner spring contacts (802, 803). In the figures, the spring contacts (802, 803) are already folded, and leave the opening (804) available for the integration of other components. In the case of FIG. 8*a*, the PCB (801) includes a matching network (805) connected to the landing area of at least one of the spring contacts (802, 803). A transmission line (807) (such as for instance, but not limited to, a microstrip line, coplanar line, or stripline) connects the matching network (805) to an RF circuit (808). At some point along the transmission line (807) between the matching network (805) and the RF circuit (808), and under the projection of the opening (804) on the PCB (801), there is an RF connector (806). The RF connector (806) can be accessed from the outside of the handset or wireless device through the opening in the antenna (804), and can be used, for example, for the purposes of testing the output power level of the RF circuit (808). FIG. 8*b* presents another embodiment in which the opening (804) is advantageously used to place the objective of a digital camera (850).

In some cases, it can be advantageous to use the gap, opening or empty space that becomes available after folding the strips of the spring contacts, to integrate electrical, mechanical or electromechanical components carried by the PCB (such as for instance a loudspeaker) and that do not have to be accessible from the outside of the handset or wireless device, but which should preferably not be placed underneath a conductive part of the antenna, for example, so as not to interfere with the antenna.

The present invention can be applied to antennas with different antenna topologies, both balanced and unbalanced. In particular, monopoles, dipoles, loops, folded and loaded monopoles and dipoles, and their slot or aperture equivalents (slot monopoles, slot dipoles, slot loops, folded and loaded slot monopoles and dipoles) are some of the structures in which the present invention can be applied. Other structures include shorted and bent monopoles (L-shaped monopoles, inverted-F antennas or IFA), multibranch structures, coupled monopoles and dipole antennas and again their aperture equivalents. Another possible antenna configuration is a microstrip or patch antenna, including their shorted versions (shorted patches and planar inverted-F or PIFA structures). All of these antennas could use an inner spring contact according to the present invention to connect the antenna to the pad or electrical contact region on the PCB.

In some preferred embodiments the handset or wireless device comprising an antenna with at least one inner spring contact is operating at one, two, three or more of the following communication and connectivity services: GSM (GSM850, GSM900, GSM1800, American GSM or PCS1900, GSM450), UMTS, WCDMA, CDMA, Bluetooth™, IEEE802.11a, IEEE802.11b, IEEE802.11g, WLAN, WiFi, UWB, ZigBee, GPS, Galileo, SDARs, XDARS, WiMAX, DAB, FM, DMB, DVB-H.

The invention claimed is:

1. An antenna for a wireless device comprising:

a main body;

a first strip;

a second strip;

wherein the first strip and the second strip extends from the main body for constituting at least two contact elements for connecting the main body to at least two contact elements of said wireless device;

wherein the first strip, the second strip and said main body are formed out of a same plate of electrically conductive material;

wherein the first strip comprises a first free end and an end connected to the main body at a first point of transition between the main body and the first strip;

wherein the second strip comprises a second free end and an end connected to the main body at a second point of transition between the main body and the second strip;

wherein the antenna is configured so that when said plate is made flat with the first strip, the second strip and said main body lying on a same plane, then a first area being an area of a smallest possible rectangle that encompasses a perimeter of the main body and that of said first strip and said second strip and a second area being an area of a smallest possible rectangle that encompasses the perimeter of the main body, are identical;

wherein the antenna is configured so that when said plate is made flat with said first strip, said second strip and said main body lying on a same plane, then said main body comprises within said second area, a gap in the main body, said first strip extending into said gap from a first edge of said main body that delimits said gap;

wherein a distance along a longitudinal direction of the first strip and away from the gap between said first point of transition and a first side of a perimeter of the second area is smaller than a distance between said first point of transition and a midpoint between two opposite sides of the perimeter of the second area along said longitudinal direction, so that the first strip extends from said first edge towards a more central portion of the main body;

wherein the electrically conductive material of the main body extends continuously along said longitudinal direction between said first point of transition and said first side, so that when the first strip is folded about said point of transition, the free end is proximate to said first side;

wherein one strip of the first strip and the second strip serves as a contact element for feeding the antenna; and wherein the other strip of the first strip and the second strip serves as a contact element for connecting the antenna to ground.

2. The antenna according to claim 1, wherein said gap is completely surrounded by electrically conductive material of said main body, so that said gap is an internal gap within said main body, and wherein said first strip and said second strip, when arranged on the same plane as said main body, is entirely housed within said gap.

3. The antenna according to claim 1, wherein:

the second strip extends into the gap from a second edge of the main body that delimits the gap;

wherein a distance along a longitudinal direction of the second strip and away from the gap between said second point of transition and a second side of the perimeter of the second area is smaller than a distance between said second point of transition and a midpoint between two opposite sides of the perimeter of the second area along the longitudinal direction of the second strip; and wherein the electrically conductive material of the main body extends continuously along the longitudinal direction of the second strip between said second point of transition and said second side.

4. The antenna according to claim 3, wherein the first strip and the second strip extend into the gap from a same edge of the main body that delimits the gap.

5. The antenna according to claim 3, wherein said first strip and the second strip extend into the gap from different edges of said main body that delimit said gap.

6. The antenna according to claim 1, wherein:

the main body comprises, within the second area, a second gap;

wherein the second strip extends into the second gap from a second edge of the main body that delimits the second gap;

wherein a distance along the longitudinal direction of the second strip and away from the second gap between said second point of transition and a second side of the perimeter of the second area is smaller than a distance between said second point of transition and a midpoint between two opposite sides of the perimeter of the second area along the longitudinal direction of the second strip; and wherein the electrically conductive material of the main body extends continuously along the longitudinal direction of the second strip between said second point of transition and said second side.

7. The antenna according to claim 1, wherein said gap is not completely surrounded by conductive material of said main body.

8. The antenna according to claim 1, wherein the second free end is not facing, in a longitudinal direction of said second strip, any edge of said main body that delimits said gap.

9. The antenna according to claim 1, wherein said first point of transition is placed at a small distance from the perimeter of said second area.

10. The antenna according to claim 9, wherein said small distance is a distance of less than 10% of an extension of said second area in the longitudinal direction of the first strip.

11. The antenna according to claim 9, wherein said small distance is a distance of less than 10% of a length of the shortest side of said second area.

12. The antenna according to claim 1, wherein the second strip extends into the gap from a second edge of the main body that delimits the gap.

13. The antenna according to claim 1, wherein the first strip and the second strip extend in substantially parallel directions.

14. The antenna according to claim 1, wherein said first strip and the second strip extend in substantially perpendicular directions.

15. The antenna according to claim 1, wherein the first strip extends in a direction contrary to the direction of the second strip.

16. The antenna according to claim 1, wherein the first strip and the second strip have different lengths.

17. The antenna according to claim 1, wherein a perimeter of said main body is shaped as a curve having at least five segments that are connected in such a way that each segment forms an angle with any adjacent segment, such that no pair of adjacent segments defines a larger straight segment, and wherein said curve does not intersect with itself at any point except, at the initial and final point of said curve, and wherein the segments of the curve are shorter than one fifth of the free-space operating wavelength.

18. The antenna according to claim 17, wherein said segments are shorter that one tenth of the free-space operating wavelength.

19. The antenna according to claim 1, wherein a perimeter of said main body is shaped as a curve having a box-counting dimension larger than 1.1.

20. The antenna according to claim 19, wherein a perimeter of said main body is shaped as a curve having a box-counting dimension larger than 1.5.

21. The antenna according to claim 1, wherein a perimeter of said main body is shaped as a curve having a grid dimension larger than 1.

22. The antenna according to claim 21, wherein a perimeter of said main body is shaped as a curve having a grid dimension larger than 1.5.

23. The antenna according to claim 1, wherein said main body comprises at least one multilevel structure.

24. The antenna according to claim 1, wherein said main body is a radiating element of said antenna and wherein said antenna is at least one of: a monopole antenna, a dipole antenna, a patch antenna, an inverted-F antenna, and a planar inverted-F antenna.

25. The antenna according to claim 1, wherein the first strip has the free end facing, in the longitudinal direction of the strip, an edge of the main body that delimits the gap.

26. The antenna according to claim 1, wherein said first strip is bent at least once to extend in a direction substantially orthogonal to said main body.

27. The antenna according to claim 1, wherein said first strip is arranged to constitute a spring contact for connecting the main body to an element of said wireless device.

28. The antenna according to claim 1, wherein a width of the first strip is in a range from approximately 0.5 mm to approximately 4 mm.

29. The antenna according to claim 1, wherein the gap containing the first strip has a width larger than twice a width of the first strip.

30. The antenna according to claim 1, wherein a perimeter of said main body is shaped as a curve having at least five segments that are connected in such a way that each segment forms an angle with any adjacent segment, such that no pair of adjacent segments defines a larger straight segment, and wherein said curve does not intersect with itself at any point, and wherein the segments of the curve are shorter than one fifth of the free-space operating wavelength.

31. An antenna for a wireless device comprising:

a main body;

a first strip;

a second strip;

wherein the first strip and the second strip extends from said main body for constituting at least two contact elements for connecting the main body to at least two elements of said wireless device;

wherein the first strip, the second strip and said main body are formed out of a the same plate of electrically conductive material;

wherein the first strip comprises a first free end and an end connected to the main body at a first point of transition between the main body and the first strip;

wherein the second strip comprises a second free end and an end connected to the main body at a second point of transition between the main body and the second strip;

wherein the antenna is configured so that when said plate is made flat with said first strip, said second strip and said main body lying on a same plane, then a first area being an area of a smallest possible rectangle that encompasses a perimeter of the main body and that of said first strip and said second strip and a second area being an area of a smallest possible rectangle that encompasses the perimeter of the main body, are identical;

wherein the antenna is configured so that when said plate is made flat with said first strip, said second strip and said main body lying on a same plane, then said main body comprises, within said second area, a gap in said main body, said first strip extending into said gap from a first edge of said main body that delimits said gap;

wherein a distance along a longitudinal direction of the first strip and away from the gap between said first point of transition and a first side of a perimeter of the second area is smaller than a distance between said first point of transition and a midpoint between two opposite sides of the perimeter of the second area along said longitudinal direction, so that the first strip extends from said first edge towards a more central portion of the main body;

wherein at least one said first point of transition and said second point of transition is placed at a small distance from the perimeter of said second area;

wherein said small distance is less than 20% of an extension of the second area in said longitudinal direction and less than 20% of a length of a shortest side of the second area;

wherein one strip of the first strip and the second strip serves as a contact element for feeding the antenna; and wherein the other strip of the first strip and the second strip serves as a contact element for connecting the antenna to ground.

32. The antenna according to claim 31, wherein said small distance is less than 10% of the extension of the second area in said longitudinal direction.

33. The antenna according to claim 31, wherein said small distance is less than 10% of the length of the shortest side of the second area.

34. The antenna according to claim 31, wherein the first free end of the first strip is not facing, in the longitudinal direction of said first strip, an edge of said main body that delimits said gap.

35. The antenna according to claim 31, wherein said first strip is bent at least once to extend in a direction substantially orthogonal to said main body.

36. The antenna according to claim 31, wherein said first strip is arranged to constitute a spring contact for connecting the main body to an element of said wireless device.

37. The antenna according to claim 31, wherein a width of the first strip is in a range from approximately 0.5 mm to approximately 4 mm.

38. The antenna according to claim 31, wherein the gap containing the first strip has a width larger than twice a width of the first strip.

39. The antenna according to claim 31, wherein the second strip extends into the gap from a second edge of the main body that delimits the gap.

40. The antenna according to claim 31, wherein the first strip and the second strip extend in substantially parallel directions.

41. The antenna according to claim 31, wherein said first strip and the second strip extend in substantially perpendicular directions.

42. The antenna according to claim 31, wherein the first strip and the second strip extend into the gap from a same edge of the main body that delimits the gap.

43. The antenna according to claim 31, wherein said first strip and the second strip extend into the gap from different edges of said main body that delimit said gap.

44. The antenna according to claim 31, wherein the first strip extends in a direction contrary to the direction of the second strip.

45. The antenna according to claim 31, wherein the first strip and the second strip have different lengths.

46. A wireless device comprising:

a printed circuit board, the printed circuit board comprising a ground plane and an antenna element;

wherein the antenna element is mounted on the printed circuit board, said antenna element comprising:

at least two spring contacts;

wherein said antenna element is fabricated including the steps of stamping a flat solid plate of conductive material such that a substantially flat structure of a particular shape is obtained;

said substantially flat structure comprising:

a main body;

a first strip, the first strip being used to create at least one of said at least two spring contacts;

a second strip, the second strip being used to create at least one of said at least two spring contacts;

wherein a geometry of the substantially flat structure defines an opening within an extension of the main body so that the first strip and the second strip fit completely inside the opening;

wherein the first strip comprises a first free end and an end connected to the main body at a first point of transition between the main body and the first strip, the first strip extending into the opening from a first edge of the main body that delimits the opening;

wherein the second strip comprises a second free end and an end connected to the main body at a second point of transition between the main body and the second strip, the second strip extending into the opening from a second edge of the main body that delimits the opening;

wherein the first strip extends longitudinally from said first edge towards a more central portion of the main body;

wherein the second strip extends longitudinally from said first edge towards a more central portion of the main body;

wherein a first area of a smallest possible rectangle that encompasses a perimeter of the main body and that of the first strip and the second strip is approximately equal to a second area of a smallest possible rectangle that encompasses the perimeter of the main body;

wherein one strip of the first strip and the second strip serves as a contact element for feeding the antenna;

wherein the other strip of the first strip and the second strip serves as a contact element for connecting the antenna to ground;

wherein said first strip is in contact with said printed circuit board at a first area of connection located at a small distance from an edge of said printed circuit board; and wherein said small distance is less than 10% of a length of the printed circuit board.

47. The antenna according to claim 46, wherein the opening containing the first strip has a width larger than twice a width of the first strip.

48. The antenna according to claim 47, wherein the width of the first strip is in the range from approximately 0.5 mm to approximately 4 mm.

49. The antenna according to claim 46, wherein the first strip and the second strip extend in substantially perpendicular directions.

50. The antenna according to claim 46, wherein said first edge and said second edge are a same edge of the main body that delimits the opening.

51. The antenna according to claim 46, wherein said first edge and said second edge are different edges of the main body that delimit the opening.

52. A wireless device comprising:

a printed circuit board, the printed circuit board comprising a ground plane and an antenna element;

wherein the antenna element is mounted on the printed circuit board, said antenna element comprising:

a main body;

a first strip extending from the main body for constituting a first contact element for connecting the main body to an element of said wireless device;

wherein the first strip and said main body are both formed out of a same plate of electrically conductive material;

wherein the first strip comprises a first free end and an end connected to the main body at a first point of transition between the main body and the first strip;

wherein the antenna element is configured so that when said plate is made flat with said first strip and said main body lying on a same plane, then a first area being an area of a smallest possible rectangle that encompasses a perimeter of the main body and that of said first strip and a second area being an area of a smallest possible rectangle that encompasses the perimeter of the main body, are identical;

wherein the antenna element is configured so that when said plate is made flat with said first strip and said main body lying on a same plane, then said main body comprises, within said second area, a gap in the main body, said first strip extending into said gap from a first edge of said main body that delimits said gap;

wherein a distance along a longitudinal direction of the first strip and away from the gap between said first point of transition and a first side of a perimeter of the second area is smaller than a distance between said first point of transition and a midpoint between two opposite sides of the perimeter of the second area along said longitudinal direction, so that the first strip extends from said edge towards a more central portion of the main body;

wherein the electrically conductive material of the main body extends continuously along said longitudinal direction between said first point of transition and said first side, so that when the first strip is folded about said first point of transition, the free end is proximate to said first side; and wherein said wireless device includes at least one component arranged on said printed circuit board in correspondence with said gap so that said at least one component is accessible through said gap.

53. The wireless device according to claim 52, wherein said first strip is in contact with said printed circuit board at an area of connection located at a small distance from an edge of said printed circuit board.

54. The wireless device according to claim 53, wherein said small distance is less than 10% of a length of the printed circuit board.

55. The wireless device according to claim 54, wherein said small distance is less than 5% of the length of the printed circuit board.

56. The wireless device according to claim 52, wherein an orthogonal projection of the main body of the antenna on the printed circuit board is entirely within a perimeter of said printed circuit board.

57. The wireless device according to claim 52, wherein said at least one component is at least one of a radio frequency connector and an objective of a camera.

58. A method of arranging components in a wireless device including at least one antenna, the antenna comprising:

a main body;

a strip extending from the main body for constituting a contact element for connecting the main body to an element of said wireless device;

wherein the strip and said main body are both formed out of a same plate of electrically conductive material;

wherein the strip comprises a free end and an end connected to the main body at a point of transition between the main body and the strip;

wherein the antenna is configured so that when said plate is made flat with said strip and said main body lying on a same plane, then a first area being an area of a smallest possible rectangle that encompasses a perimeter of the main body and that of said strip and a second area being an area of a smallest possible rectangle that encompasses the perimeter of the main body, are identical;

wherein the antenna is configured so that when said plate is made flat with said strip and said main body lying on a same plane, then said main body comprises, within said second area, a gap in the main body, said strip extending into said gap from an edge of said main body that delimits said gap;

wherein a distance along a longitudinal direction of the strip and away from the gap between said point of transition and a first side of a perimeter of the second area is smaller than a distance between said point of transition and a midpoint between two opposite sides of the perimeter of the second area along said longitudinal direction, so that the strip extends from said edge towards a more central portion of the main body;

wherein the electrically conductive material of the main body extends continuously along said longitudinal direction between said point of transition and said first side, so that when the strip is folded about said point of transition, the free end is proximate to said first side;

wherein said wireless device comprises at least one component; and wherein said at least one component is arranged in correspondence with said gap so that said at least one component is accessible through said gap.

* * * * *